US008621684B2

(12) United States Patent
Okumatsu

(10) Patent No.: US 8,621,684 B2
(45) Date of Patent: Jan. 7, 2014

(54) TRANSFER ASSIST APPARATUS

(75) Inventor: Yoshihiro Okumatsu, Toyota (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 0 days.

(21) Appl. No.: 13/145,692

(22) PCT Filed: Jan. 21, 2010

(86) PCT No.: PCT/IB2010/000167
§ 371 (c)(1),
(2), (4) Date: Jul. 21, 2011

(87) PCT Pub. No.: WO2010/084421
PCT Pub. Date: Jul. 29, 2010

(65) Prior Publication Data

US 2011/0277235 A1 Nov. 17, 2011

(30) Foreign Application Priority Data

Jan. 22, 2009 (JP) ..... 2009-011997

(51) Int. Cl.
*A61G 7/10* (2006.01)

(52) U.S. Cl.
USPC ..... 5/83.1; 5/81.1 R; 5/87.1

(58) Field of Classification Search
USPC ..... 5/81.1 R, 83.1, 85.1–87.1, 89.1
See application file for complete search history.

(56) References Cited

U.S. PATENT DOCUMENTS 3,694,829 A 10/1972 Bakker
3,996,632 A 12/1976 Bakker nee Viel
5,001,789 A 3/1991 Schoenberger
5,367,721 A * 11/1994 Boyles ..... 4/496
5,379,468 A * 1/1995 Cassidy et al. ..... 5/86.1
7,392,554 B1 7/2008 Su et al.

(Continued)

FOREIGN PATENT DOCUMENTS

CN 1792353 * 6/2006
CN 1792353 A 6/2006

(Continued)

OTHER PUBLICATIONS

Office Action issued May 25, 2012 in Chinese Patent Application No. 2010800054121.3 and English translation thereof.

(Continued)

*Primary Examiner* — Michael Trettel
*Assistant Examiner* — Richard G Davis
(74) *Attorney, Agent, or Firm* — Kenyon & Kenyon LLP

(57) ABSTRACT

A transfer assist apparatus includes an anxiety measurement unit that detects a physical change linked to a sense of anxiety in the care-receiver and measures a degree of anxiety in the care-receiver, and a control unit that control the drive unit correspondingly to a trajectory inputted by the operation unit and performs feedback control so as to reduce the degree of anxiety measured by the anxiety measurement unit. The anxiety measurement unit detects at least one of a heart rate, an amount of perspiration, a breathing rate, an eyeball movement, an electric resistance of skin, and a skin temperature as the physical change linked to a sense of anxiety in the care-receiver. The control unit sets a speed limit of the drive unit correspondingly to the degree of anxiety measured by the anxiety measurement unit and restricts the drive speed of the drive unit not to exceed the speed limit.

18 Claims, 25 Drawing Sheets

(56) References Cited

U.S. PATENT DOCUMENTS

| | | | | |
|---|---|---|---|---|
| 7,827,630 | B2 * | 11/2010 | Bostelman et al. | 5/87.1 |
| 2003/0208844 | A1 * | 11/2003 | Moffa et al. | 5/86.1 |
| 2005/0217024 | A1 * | 10/2005 | Aarestad | 5/86.1 |
| 2006/0137577 | A1 | 6/2006 | Chang et al. | |
| 2008/0301872 | A1 | 12/2008 | Fahrig et al. | |
| 2009/0165204 | A1 | 7/2009 | Biersteker et al. | |
| 2009/0276955 | A1 * | 11/2009 | Palay et al. | 5/87.1 |
| 2010/0064431 | A1 | 3/2010 | Kawakami et al. | |
| 2010/0154117 | A1 * | 6/2010 | Odashima et al. | 5/87.1 |

FOREIGN PATENT DOCUMENTS

| | | | |
|---|---|---|---|
| EP | 0304538 | | 2/1988 |
| JP | 62-87154 | A | 4/1987 |
| JP | 62079058 | | 11/1987 |
| JP | 05-021938 | U | 3/1993 |
| JP | 6279058 | A | 10/1994 |
| JP | 6287154 | A | 11/1994 |
| JP | 07-016269 | A | 1/1995 |
| JP | 08-191865 | A | 7/1996 |
| JP | 09-276335 | A | 10/1997 |
| JP | 10-295744 | A | 11/1998 |
| JP | 2000-084012 | A | 3/2000 |
| JP | 2001-104409 | A | 4/2001 |
| JP | 2002065762 | A | 5/2002 |
| JP | 2002065762 | | 3/2005 |
| JP | 2005-237871 | A | 9/2005 |
| JP | 2006-305092 | A | 11/2006 |
| JP | 2008-073501 | A | 4/2008 |
| JP | WO2008129847 | A1 * | 10/2008 |
| WO | 2004/100100 | A1 | 11/2004 |
| WO | 2008/129847 | A1 | 10/2008 |
| WO | 2008117538 | | 10/2008 |
| WO | 2008117538 | A1 | 10/2008 |

OTHER PUBLICATIONS

International Search Report issued May 21, 2010 in PCT/IB2010/000167 & Written Opinion.

Office Action issued on Oct. 27, 2010 in Japanese Priority Application No. 2009-011997 and English translation thereof.

Cited in Office Action issued for U.S. Appl. No. 12/642,165 mailed Nov. 7, 2012.

Office Action issued for U.S. Appl. No. 12/642,165 on May 23, 2013.

Partial Translation of Notification of Reasons for Refusal of JP Application No. 2008-325379.

* cited by examiner

TRANSFER ASSIST APPARATUS

BACKGROUND OF THE INVENTION

1. Field of the Invention

The invention relates to a transfer assist apparatus, for example, a transfer assist apparatus that assists in a transfer operation for a person who cannot walk by oneself to transfer from a bed to a wheelchair or from the wheelchair to the toilet seat.

2. Description of the Related Art

For a care-receiver who cannot walk by oneself, it is not easy to perform by oneself the transfer movement of moving from a bed to a wheelchair. Usually, a nursing assistant has to help, but the aid in transfer movement places a large physical load on the nursing assistant and a large mental load on the care-receiver. Apparatuses that assist the transfer movement of a care-receiver who cannot walk by oneself have recently been developed. For example, Japanese Patent Application Publication No. 2006-305092 (JP-A-2006-305092) discloses a transfer assist apparatus in which a tiltable strut is provided in a raised condition on a rotatable platform and a receiving plate (holding device) is provided at the distal end of the strut. When the care-receiver has a transfer movement by using such a transfer assist apparatus, the strut is tilted and the receiving plate is brought close to the care-receiver's body. Then, the care-receiver sets hands on the holding device, clutches the holding device, moves the body onto the receiving plate, and places the body weight thereon. Where the strut is then lifted, the care-receiver's body is also lifted. After the transfer destination is reached, the strut is tilted to complete the transfer movement.

It is obviously an important problem to ensure safety of the care-receiver during the transfer assist. Japanese Patent Application Publication No. 8-191865 (JP-A-8-191865) and Japanese Patent Application Publication No. 7-016269 (JP-A-7-016269) disclose safety mechanisms in electric nursing lifts. Thus, JP-A-8-191865 discloses an electric nursing lift that hoists the care-receiver from a bed or lowers the care-receiver onto the bed, the lift having a structure such that the hoisting arm can be stretched and contracted. Therefore, even when the electric nursing lift is erroneously controlled and the care-receiver is inserted between the hoisting means and the floor, the hoisting arm is contracted to absorb the force acting upon the care-receiver. As a result, the care-receiver's safety is reliably guaranteed.

JP-A-7-016269 discloses providing a bed with an aid arm that prevents tumbling and using a structure such that restricts the movement of the hoisting arm so as to allow the hoisting arm to rotate only when the aid arm protrudes to the outside of the bed. As a result, the bed is prevented from accidents such as overturning, and care-receiver's safety is protected.

A care-receiver that requires a transfer assist has disabled zones on the body, for example, a paralyzed half of the body or paralyzed legs and cognitive impairment. Therefore, significant sense of anxiety and fear are obviously associated with a transfer movement. Furthermore, during the transfer movement, the care-receiver with a disabled body has to entrust the entire own body to a nursing assistant or a nursing robot. The nursing assistant performs the aid and transfer assist, while listening to the care-receiver's wishes, and the care-receiver's sense of anxiety and fear can be mitigated based on the trust relationship between the nursing assistant and the care-receiver. However, when the transfer assist apparatus is used, the care-receiver can hardly trust the apparatus to the same extent as the nursing assistant and the sense of anxiety and fear grow additionally. One more problem associated with the transfer assist apparatus is the presence of various factors causing sense of anxiety and fear in the care-receiver, such as operation noise caused by a motor and gears, unpredictable abrupt acceleration, transfer trajectory undesirable for the care-receiver, and operation failures. Therefore, a transfer assist apparatus that can ensure not only the care-receiver's safety, but also guarantee a sense of relief is highly desirable.

SUMMARY OF THE INVENTION

The intention provides a transfer assist apparatus that performs transfer assist, while reducing a sense of anxiety in the care-receiver.

A transfer assist apparatus according to a first aspect of the invention assists a care-receiver transfer. The apparatus includes: a movable carriage unit; an arm unit that includes a base end attached to the carriage unit and that rotates in a horizontal plane and tilted; a body holding device that is attached to the arm unit; a drive unit that drives the carriage unit and the arm unit; an operation unit into which a trajectory of the body holding device is inputted by a manual operation; and an anxiety measurement unit that detects a physical change linked to a sense of anxiety in the care-receiver and measures a degree of anxiety in the care-receiver; and a control unit that controls the drive unit correspondingly to the trajectory inputted by the operation unit and performs feedback control so as to reduce the degree of anxiety measured by the anxiety measurement unit.

According to the above-described configuration, the anxiety measurement unit may detect at least one of a heart rate, an amount of perspiration, a breathing rate, an eyeball movement, an electric resistance of skin, and a skin temperature as the physical change linked to the sense of anxiety in the care-receiver.

The control unit may also set a speed limit that is an upper limit of a drive speed of the drive unit correspondingly to the degree of anxiety in the care-receiver that is measured by the anxiety measurement unit, and restrict the drive speed of the drive unit not to exceed the speed limit.

Furthermore, the control unit may set a gain that determines a response speed of the drive unit correspondingly to the degree of anxiety in the care-receiver that is measured by the anxiety measurement unit, and send a drive command to the drive unit by using the gain that is set.

In the above-described configuration, the control unit may include a user database that stores, for each user, the degree of anxiety and a setting value to reduce the degree of anxiety.

The control unit may also include a data accumulation unit that accumulates, for each user, data when the transfer assist apparatus is used.

Furthermore, the control unit may set a feedback gain that minimizes an evaluation function that is based on a degree of anxiety in the care-receiver and a position and speed of the holding device, and use the set feedback gain in a position, speed, or acceleration feedback loop.

The transfer assist apparatus may further include an external output unit that outputs an anxiety representation signal that increases as the sense of anxiety in the care-receiver increases. The control unit generates the anxiety representation signal and outputs the signal to the external output unit to represent the sense of anxiety to an operator.

The external output unit may include a speaker or a vibrator attached to the operation unit and transmits the anxiety representation signal to an operator by sound or vibrations.

A transfer assist apparatus according to a second aspect of the invention assists a care-receiver transfer. The apparatus includes: a movable carriage unit; an arm unit that is attached to the carriage unit and that rotates in a horizontal plane and tilted; a body holding device that is attached to the arm unit; a drive unit that drives the carriage unit and the arm unit; an operation unit into which a trajectory of the body holding device is inputted by a manual operation; and a control unit that controls the drive unit correspondingly to the trajectory inputted by the operation unit, and performs a feedback control to reduce a degree of anxiety in the care-receiver by storing in advance a relief trajectory range, which is a trajectory range of the body holding device in which the care-receiver has a feeling of relief, sampling with a predetermined sampling pitch a trajectory of the body holding device that is inputted by an operator via the operation unit, comparing sampled coordinate data on the trajectory with the relief trajectory range, and when the sampled coordinate data is outside the relief trajectory range or when a point predicted based on sampled coordinate data within the relief trajectory range is predicted to be outside the relief trajectory range, correcting the trajectory of the body holding device to enter the relief trajectory range.

According to the above-described configuration, the control unit may correct, when the sampled coordinate data is outside the relief trajectory range or when the predicted point is predicted to be outside the relief trajectory range, a position of a point sampled immediately before the sampled coordinate data is sampled or the predicted point is predicted, or at least one point sampled before the sampled coordinate data is sampled or the predicted point is predicted, and generate a trajectory that is corrected such that a point predicted based on the corrected sampled position is within the relief trajectory range.

A transfer assist apparatus according to a third aspect of the invention assists a care-receiver transfer operation. The apparatus includes: a movable carriage unit; an arm unit that includes a base end attached to the carriage unit and that rotates in a horizontal plane and tilted; a body holding device that is attached to the arm unit; a drive unit that drives the carriage unit and the arm unit; an operation unit into which a trajectory of the body holding device is inputted by a manual operation; and a control unit that controls the drive unit correspondingly to the trajectory inputted by the operation unit, and performs a feedback control to reduce a degree of anxiety in the care-receiver by storing in advance a relief trajectory range, which is a trajectory range of the body holding device in which the care-receiver has a feeling of relief, sampling with a predetermined sampling pitch a trajectory of the body holding device that an operator inputs by the operation unit, comparing sampled coordinate data on the trajectory with the relief trajectory range, and when the sampled coordinate data is outside the relief trajectory range or when a point predicted based on sampled coordinate data within the relief trajectory range is predicted to be outside the relief trajectory range, instructing the operation unit to generate a reaction force in a direction that causes resistance to an input operation that inputs the trajectory that deviates from the relief trajectory range.

In the above-described configuration, the control unit may sample a trajectory of the body holding device by calculating from time to time a position of the body holding device on the basis of a drive amount of the dive unit.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Embodiments of the invention are illustrated by the appended drawings and will be explained with reference to numerals denoting various components.

First Embodiment

Figure 1:
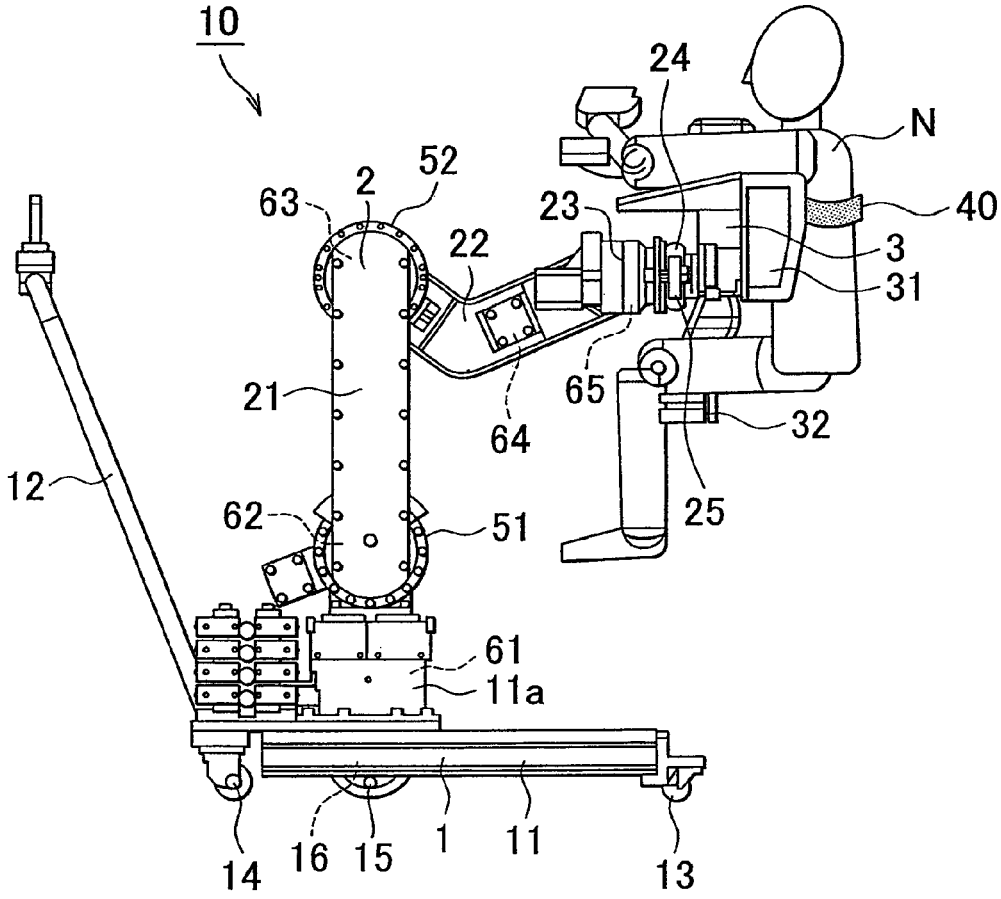
FIG. 1 is a side view of the transfer assist apparatus according to the first embodiment of the invention.

The first embodiment of the invention will be explained below. FIG. 1 is a side view of a transfer assist apparatus according to the first embodiment of the invention. A transfer assist apparatus 10 is provided with a carriage unit 1, a robot arm unit 2 coupled to the carriage unit 1, and a holding device 3 attached to the robot arm unit 2.

The carriage unit 1 has a carriage body 11, a handle section 12 for pushing and moving the carriage unit 1, a pair of left and right front aid wheels 13 attached to the front portion of the carriage body 11, a pair of left and right rear aid wheels 14 attached to the rear portion of the carriage body 11, and a pair of left and right drive wheels 15 that are attached to a substantially central portion of the carriage body 11 and drive the carriage unit 1. A pair of left and right sixth motors 16 that drive the drive wheels 15 is coupled to the pair of left and right drive wheels 15.

The robot arm unit 2 is a multijoint arm that has a first arm section 21, a second arm section 22, and a third arm section 23. The first arm section 21 is coupled to a base section 11*a* of the carriage body 11 by a first joint section 51 so as to enable the rotation about a yaw axis and a pitch axis. The second arm section 22 is coupled to the first arm section 21 by a second joint section 52 to enable the rotation about the pitch axis. One end of the third arm section 23 is coupled to the second arm section 22 by a third joint section to enable the rotation about the pitch axis (the third joint section is not shown in FIG. 1 because it is located behind the third arm section and cannot be seen). The other end of the third arm section 23 is coupled by a fourth joint section to an attachment section 24 for attaching the holding device 3 so as to enable the rotation about a roll axis (the fourth joint section is not shown in FIG. 1 because it is located inside the third arm section and cannot be seen). The attachment section 24 has a conventional attachment structure (for example, a tightening structure using a bolt and a nut or a fitting structure) that enables attachment and detachment of the holding device 3.

The yaw axis as referred to herein is a rotation axis of the first arm section 21 and extends in the vertical direction. The pitch axis as referred to herein is a rotation axis in a case where the first arm section 21, second arm section 22, and third arm section 23 rotate in the up-down direction. The roll axis as referred to herein is a rotation axis in a case where the attachment section 24 and the holding device 3 rotate with respect to the third arm section 23. The roll axis corresponds to the axial line of the third arm section 23.

A first motor (drive means) 61 that rotationally drives the first arm section 21 about the yaw axis is provided at the base section 11*a* of the carriage body 11. A second motor (drive means) 62 that rotationally drives the first arm section 21 about the pitch axis is provided at the first joint section 51. A third motor (drive means) 63 that rotationally drives the second arm section 22 about the pitch axis is provided at the second joint section 52. A fourth motor (drive means) 64 that rotationally drives the third arm section 23 about the pitch axis is provided at the third joint section. A fifth motor (drive means) 65 that rotationally drives the attachment section 24 and holding device 3 about the roll axis is provided at the fourth joint section.

First to sixth motors 61, 62, 63, 64, 65, and 16 are connected via a drive circuit 18 to a control unit 17 and are rotationally driven by control signals from the control unit 17. Further, the base section 11*a* and joint sections (51, 52) are provided with rotation sensors 71, 72, 73, 74, and 75 that detect the rotational drive amount of the first to fifth motors 61, 62, 63, 64, and 65, respectively. The rotation sensors 71, 72, 73, 74, and 75 are connected to the control unit 17 and output the detected rotational drive amount to the control unit 17.

Figure 2:
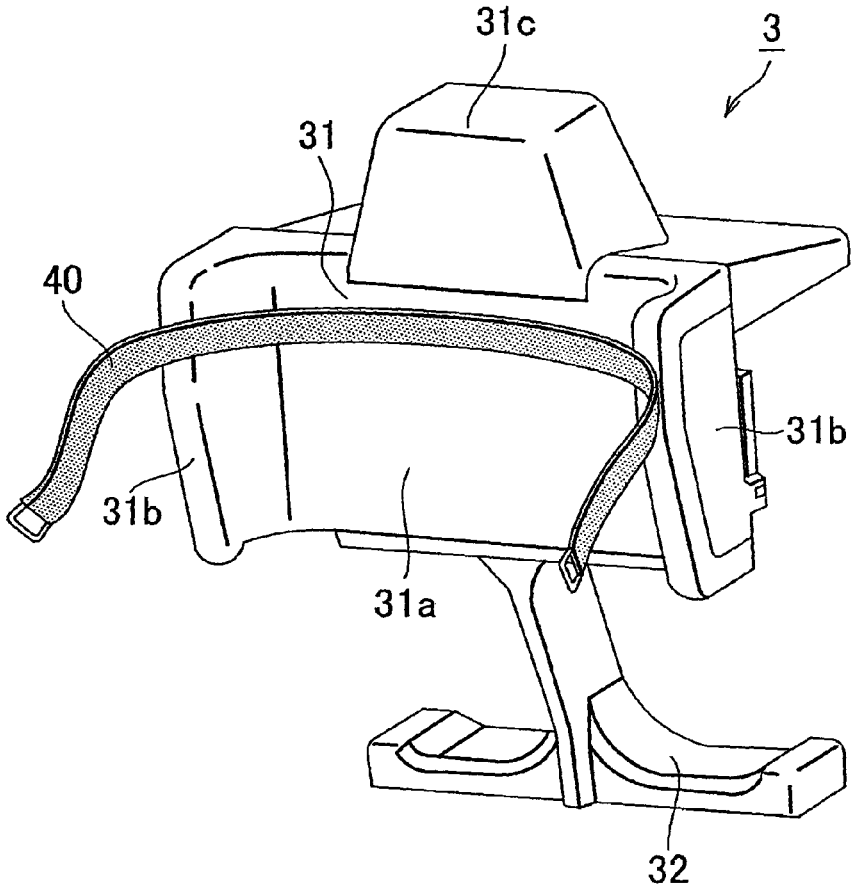
FIG. 2 is a perspective view of the holding device according to the first embodiment.

FIG. 2 is a perspective view of the holding device. The holding device 3 is attached to the attachment section 24 of the robot arm unit 2. The holding device 3 has a torso support section 31 that embraces and holds the care-receiver's torso, a lower limb support section 32 that supports lower limbs of the care-receiver, and an anxiety detection sensor that detects a sense of anxiety in the care-receiver.

The lower limb support section 32 is formed in a substantially inverted T shape and connected to the lower portion of the torso support section 31. The torso support section 31 and lower limb support section 32 are configured integrally, but may be also configured as separate sections.

The torso support section 31 is provided with a chest support section 31*a* that comes into contact with the care-receiver's chest, a pair of side surface support sections 31*b* that support the side surfaces of the chest, and a head support section 31*c* that supports a chin of a head.

The pair of side surface support sections 31*b* are formed opposite each other and extend in a substantially vertical direction from both side edges of the chest support section 31*a*. Further, the head support section 31*c* is formed as a convex portion on top of the chest support section 31*a*. The chest support section 31*a*, side surface support sections 31*b*, and head support section 31*c* are configured integrally, but may be also configured as separate sections.

The anxiety detection sensor is a heartbeat sensor 40 that detects the care-receiver's heartbeat. Sensors of various systems such as an IR radiation system and an electric potential system can be used. The heartbeat sensor 40 is in the form of a belt attached to the chest area of the care-receiver and is provided at the torso support section 31. The sensor output of the heartbeat sensor 40 is outputted to an anxiety measurement unit 50. The anxiety measurement unit 50 processes the sensor signals from the anxiety detection sensor (heartbeat sensor) 40 and outputs the sensor signals to the control unit 17 an anxiety signal. Examples of signal processing conducted in the anxiety measurement unit include counting the number of pulses in the sensor signal and calculating them as a heart rate per unit time, or conducting A/D conversion.

An anxiety measurement unit is constituted by the anxiety detection sensor (heartbeat sensor 40) and anxiety measurement unit.

Figure 3:
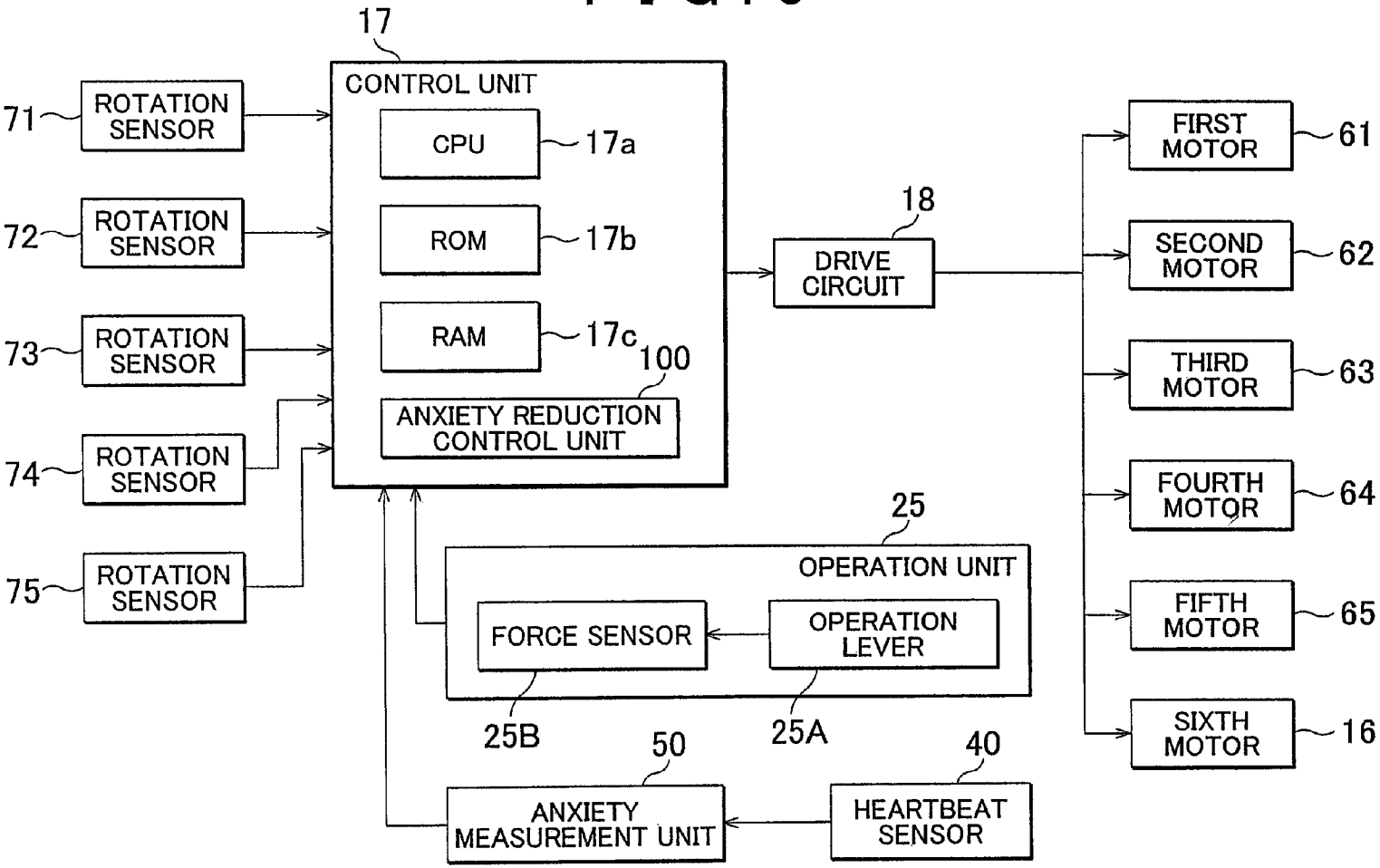
FIG. 3 is a block diagram illustrating a system configuration of the transfer assist apparatus.

FIG. 3 is a block diagram illustrating the system configuration of the transfer support apparatus. The control unit 17 that controls the rotational drive of the first to sixth motors 61, 62, 63, 64, 65, and 16 is provided at the carriage unit 1. The control unit 17 is mainly configured by a microprocessor having a Central Processing Unit (CPU) 17*a* that conducts control processing and computational processing, a Read Only Memory (ROM) 17*b* that stores a control program and a computational program that are executed by the CPU 17*a*, and a Random Access Memory (RAM) 17*c* that stores temporarily the processed data, and is also provided with an anxiety reduction control unit 100 that conducts feedback control to reduce the sense of anxiety in the care-receiver.

An operation section 25 that allows the nursing assistant to operate the transfer assist apparatus 10 is provided at the attachment section 24 of the robot arm unit 2. The operation section 25 is provided with an operation lever 25A and a force sensor 25B. The force sensor 25B detects operation corresponding to the size, direction, and momentum of the operation force applied to the operation lever 25A and outputs the operation signals to the control unit 17.

Figure 4:
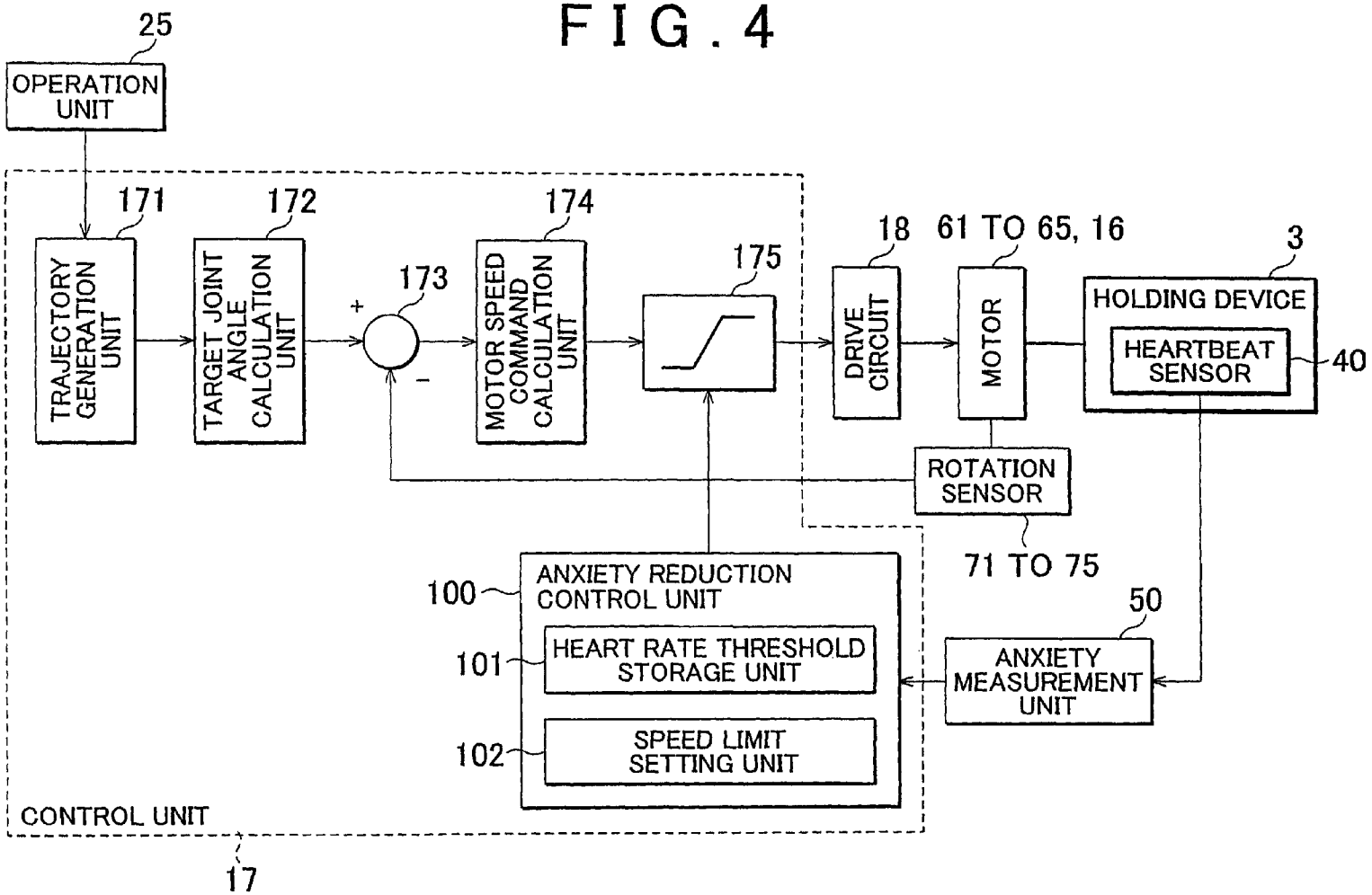
FIG. 4 is a functional block diagram of the control system according to the first embodiment.

FIG. 4 is a detailed functional block diagram of a control system realized by the control unit 17. The control unit 17 realizes the functions of a trajectory generation unit 171, a target joint angle calculation unit 172, a synthesis unit 173, a motor speed command calculation unit 174, a speed limit unit 175, and an anxiety reduction control unit 100. The operation of each functional unit will be explained below together with the operation of the entire transfer assist apparatus 10.

When the transfer assist of the care-receiver is conducted, the nursing assistant performs an operation of moving the holding device 3 by using the operation unit 25. More specifically, the holding device 3 is moved close to the care-receiver's body. An operation signal from the operation unit 25 is provided to the trajectory generation unit 171. As a result, the trajectory generation unit 171 generates a trajectory of the holding device 3 corresponding to the operation signal. The generated trajectory is provided to the target joint angle calculation unit 172. The target joint angle calculation unit 172 finds the angles for the joint sections 51 and 52 to realize the generated trajectory by calculating the angles for each joint section 51, 52.

The calculated target joint angles are outputted to the synthesis means 173. Detection values from the rotation sensors 71 to 75 are also feedback sent to the synthesis means 173. The synthesis means 173 finds the difference between the target joint angle and the present motor revolution angle for each motor 61 to 65 and 16 and provides the found differences to the motor speed command calculation unit 174. The motor speed command calculation unit 174 multiplies the rotation angle difference by a predetermined gain and calculates a speed command that will be sent to each motor. The calculated motor speed command is provided to the motors 61 to 65 and 16 via the drive circuit 18. As a result, the arm unit 2 is driven by the motor drive, and the holding device 3 moves in front of the care-receiver's body along the trajectory and at the speed intended by the nursing assistant.

The care-receiver then grasps the holding device 3 that is in front of the care-receiver's body and moves to the holding device 3. After the care-receiver has moved to the holding device 3, the nursing assistant wounds the heartbeat sensor 40 serving as an anxiety detection sensor around the chest portion of the care-receiver to set the sensor. The heartbeat of the care-receiver is detected by the heartbeat sensor 40, and the sensor signal is outputted to the anxiety measurement unit 50. The degree of anxiety (heart rate) measured by the anxiety measurement unit 50 is provided to the anxiety reduction control unit 100.

The anxiety reduction control unit 100 of the embodiment that conducts the feedback control to reduce the sense of anxiety in the care-receiver will be explained below. The anxiety reduction control unit 100 is provided with a heart rate threshold storage unit (anxiety threshold storage unit) 101 that stores heart rate thresholds (anxiety thresholds) of several stages and a speed limit setting unit 102 that sets a speed limit of the motors corresponding to the heart rate threshold.

Figure 5:
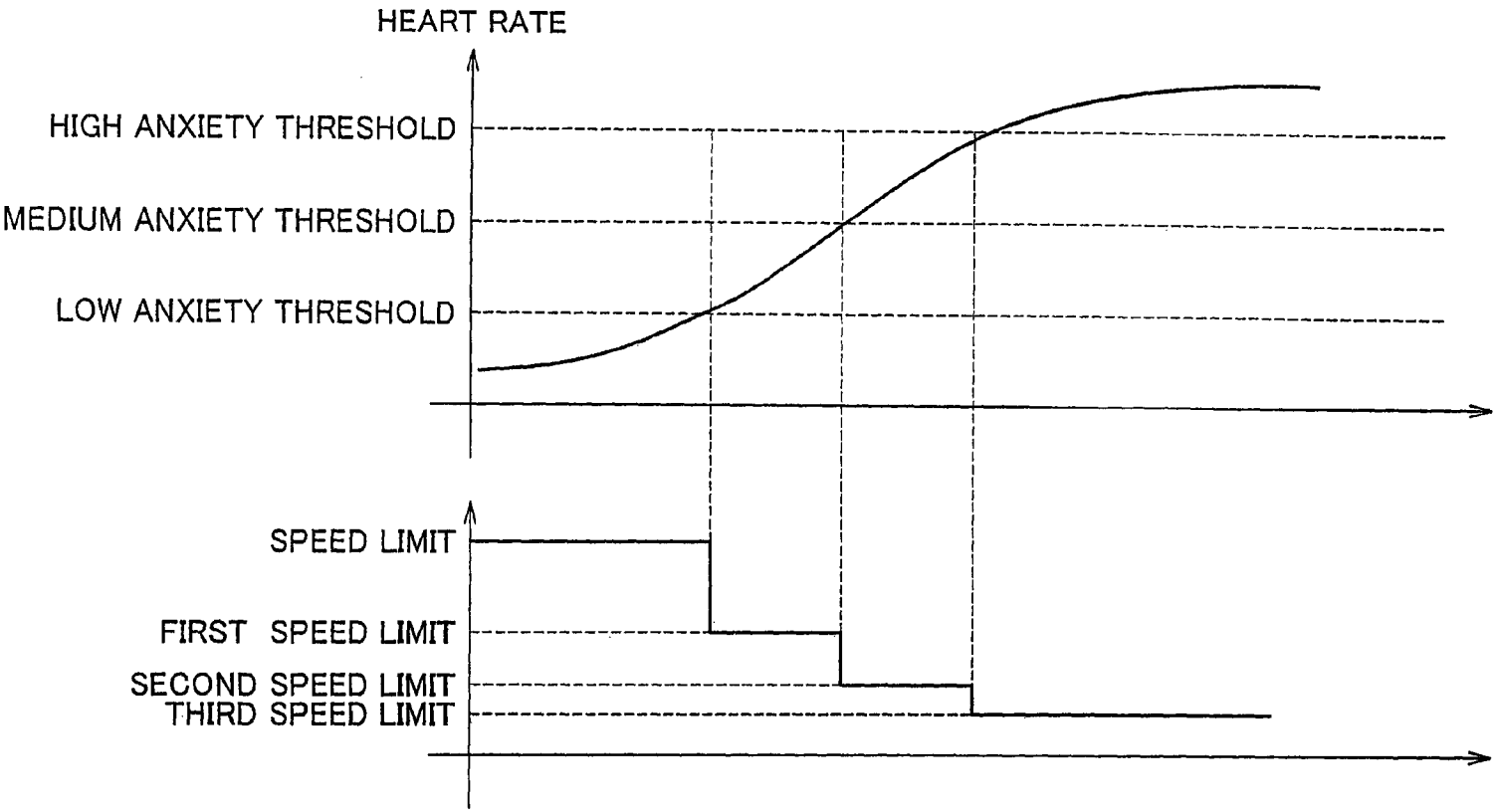
FIG. 5 shows the relationship between a heart rate threshold and a speed limit.

FIG. 5 shows a relationship between the heart rate threshold and the speed limit. A low anxiety threshold, a medium anxiety threshold, and a high anxiety threshold are set in the order from the lower heart rate as the heart rate thresholds. The speed limit of the motor revolution speed is set at several stages correspondingly to each threshold. Here, a first speed limit, a second speed limit, and a third speed limit are set correspondingly to the anxiety thresholds, and the settings are such that the higher is the heart rate (sense of anxiety), the lower is the speed limit.

The speed limit setting unit 102 sets an upper limit of a motor speed correspondingly to the care-receiver's heart rate provided from time to time from the anxiety degree measurement unit 50 and the thresholds stored in the heart rate threshold storage unit 101. For example, when the heart rate is between the low anxiety threshold and medium anxiety threshold, the first speed limit is the upper limit for the motor revolution speed.

The transfer assist device 10 has a plurality of motors 61 to 65 and 16, and thus settings of the speed limit may be conducted for each motor.

The speed limit unit 175 is provided between the motor speed command calculation unit 174 and the drive circuit 18, and the speed limit that has been set by the anxiety reduction control unit 100 is provided to the speed limit unit 175. The speed limit unit 175 sends a speed command to the drive circuit 18, such that the motor speed command does not exceed the speed limit, according to the set speed limit.

In a state in which such a control system functions, the nursing assistant raises the holding device 3 and lifts the care-receiver's body. In this case, the speed limit of the motor is set correspondingly to the care-receiver's heart rate, and the movement speed of the holding device 3 is automatically restricted. Where the sense of anxiety in the care-receiver intensifies, the movement speed of the holding device 3 is automatically decreased. As a result, even with a care-receiver who feels anxiety at a high movement speed, the movement speed is automatically restricted before the sense of anxiety becomes too strong. Therefore, the sense of anxiety is reduced.

After the nursing assistant has moved the holding device 3 together with the care-receiver to a transfer destination, the nursing assistance lowers the holding device 3 and gets the care-receiver off. The transfer assist operation is thereby completed.

With such a first embodiment, where the sense of anxiety in the care-receiver is increased to a predetermined value, the speed is automatically restricted. Therefore, the transfer assist can be performed that prevents the sense of anxiety in the care-receiver from raising to a fixed level or thereabove to reduce the sense of anxiety in the care-receiver.

Figure 6:
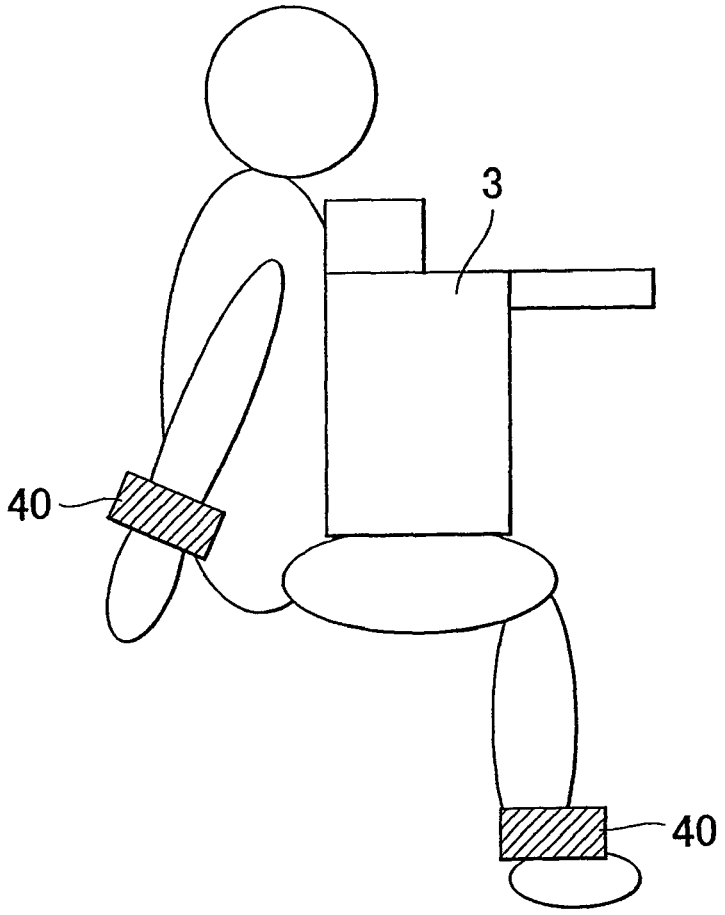
FIG. 6 shows an example of setting a heartbeat sensor at a wrist and an ankle according to a variation example 1.

(Variation Example 1) In the above-described first embodiment, a configuration is described by way of example in which the heartbeat sensor 40 serving as an anxiety detection sensor is set in the chest area of the care-receiver, but it goes without saying that the blood flow or electrocardiogram can be measured from the outside. For example, as shown in FIG. 6, the heartbeat sensor 40 may be set at a wrist or an ankle. Because the care-receiver can be assumed to have various diseases, the position for detecting the heartbeat can be appropriately selected for each care-receiver.

Figure 7:
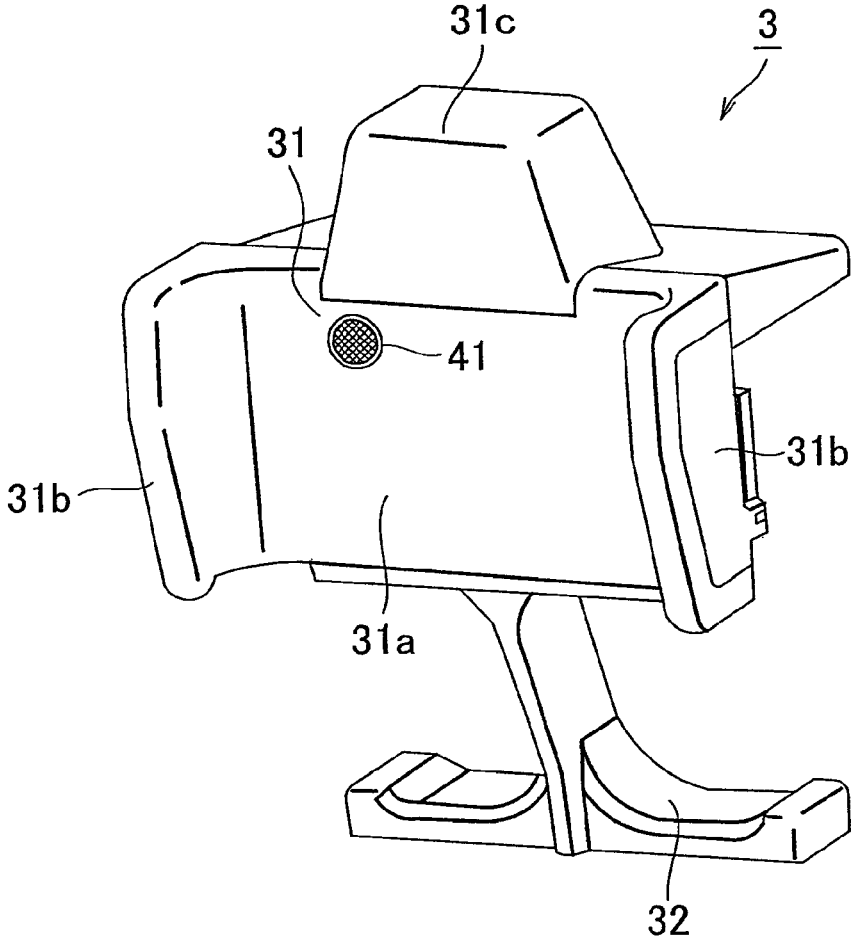
FIG. 7 shows a holding device having a microphone that detects a heart sound of the care-receiver according to a variation example 2.

(Variation Example 2) The heartbeat sensor is not limited to a configuration that senses the blood flow or electrocardiogram of the care-receiver and can also detect a heart sound. For example, as shown in FIG. 7, a microphone 41 that detects a heart sound of the care-receiver may be provided at a chest support section 31*a* of the holding device 3. Further, the anxiety measurement unit 50 converts the signals from the microphone 41 into a heart rate and provides it to the anxiety reduction control unit 100.

Figure 8:
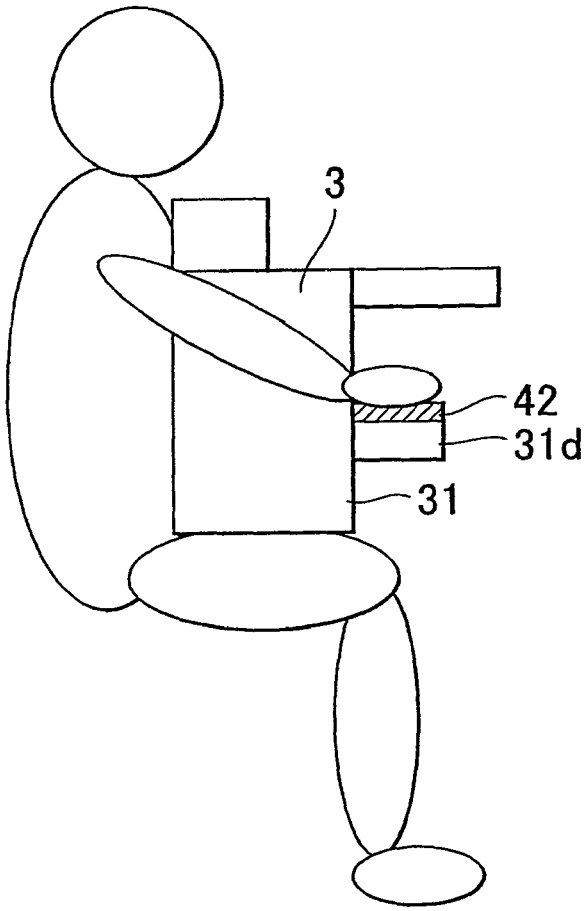
FIG. 8 shows a variation example 3.

(Variation Example 3) A variation example 3 will be explained below. A specific feature of the variation example 3 is in that a perspiration sensor 42 is used as the anxiety detection sensor that detects a sense of anxiety in the care-receiver. FIG. 8 is a side view illustrating a state in which the care-receiver is held in the holding device 3. A table section 31*d* protrudes at the rear surface side of the torso support section 31 of the holding device 3 (on the side of the torso support section 31 opposite from the care-receiver). A perspiration sensor 42 is provided on the upper surface of the table section 31*d*. Examples of devices suitable as the perspiration sensor 42 include a ventilation capsule sudorometer, a skin potential meter, and a moisture sensor. The care-receiver seating in the holding device 3 places a hand on the table section 31*d*. As a result, the perspiration sensor 42 detects the amount of perspiration at the palm of the care-receiver's hand.

Because the perspiration sensor 42 is used as the anxiety detection sensor, the configuration of the anxiety measurement unit 50 of the first embodiment is changed to measure the amount of perspiration from the sensor signal. The threshold in the anxiety reduction control unit 100 has been set to a heart rate, but now a threshold based on the amount of perspiration is used.

In such a configuration, as the sense of anxiety in the care-receiver grows, the amount of perspiration increases. The increase in the amount of perspiration is detected by the perspiration sensor 42 and the speed is automatically restricted correspondingly to the amount of perspiration. As a result, the sense of anxiety in the care-receiver is reduced.

It goes without saying that perspiration can be detected not only on the palm of the hand, but also in any location of the care-receiver's body.

Figure 9:
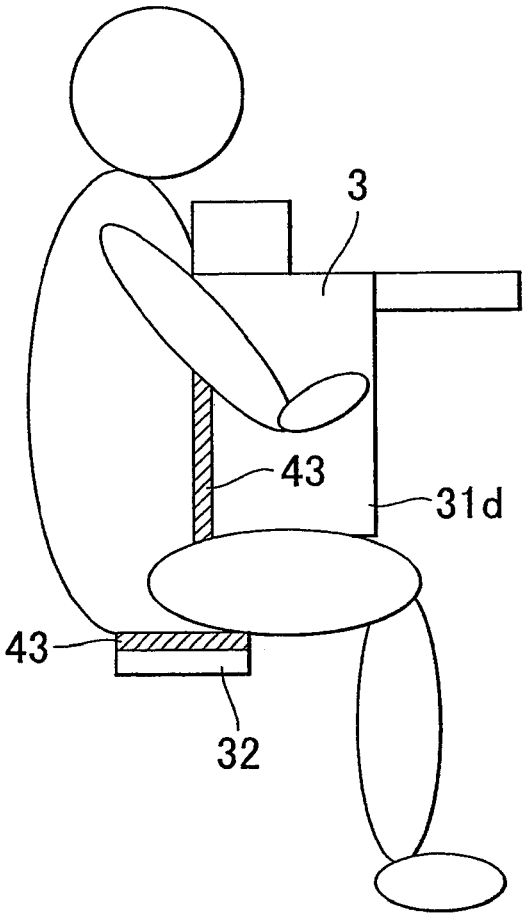
FIG. 9 shows a variation example 4.

(Variation Example 4) A variation example 4 will be explained below. A specific feature of the variation example 4 is in that a piezoelectric sensor 43 that detects microvibrations of the care-receiver is used as the anxiety detection sensor that detects a sense of anxiety in the care-receiver. FIG. 9 is a side view illustrating a state in which the care-receiver is held in the holding device 3. The piezoelectric sensors 43 are provided on the upper surface of the lower limb support section 32 of the holding device 3 and on the side of the chest support section 31*a* that faces the care-receiver. Where the care-receiver sits in the holding device 3, the care-receiver naturally comes into contact with the piezoelectric sensors 43. The piezoelectric sensors 43 detect microvibrations of the human body caused by breathing.

Because the piezoelectric sensor 43 is used as the anxiety detection sensor, the configuration of the anxiety measurement unit 50 of the first embodiment is changed to measure a breathing rate from the sensor signal. The threshold in the anxiety reduction control unit 100 has been set to a heart rate, but now a threshold based on the breathing rate is used.

In such a configuration, as the sense of anxiety in the care-receiver grows, the breathing rate increases. The increase in the breathing rate is detected by the piezoelectric sensor 43 and the speed is automatically restricted correspondingly to the breathing rate. As a result, the sense of anxiety in the care-receiver is reduced.

Figure 10:
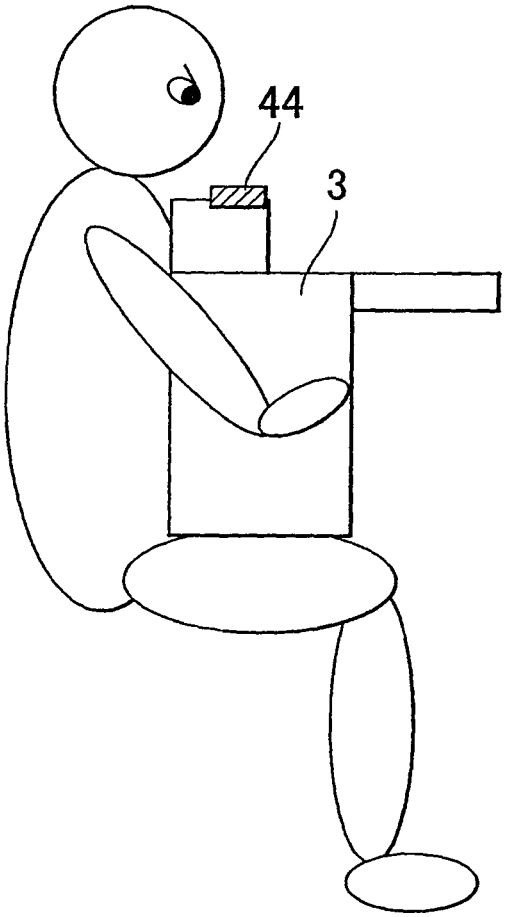
FIG. 10 shows a variation example 5.

(Variation Example 5) A variation example 5 will be explained below. A specific feature of the variation example 5 is in that a camera 44 that picks up the eyeball movement in the care-receiver is used as the anxiety detection sensor that detects a sense of anxiety in the care-receiver. FIG. 10 is a side view illustrating a state in which the care-receiver is held in the holding device 3. The camera 44 that picks up the image of the care-receiver's face is provided on the upper surface of the holding device 3. Where the care-receiver sits in the holding device 3, the camera 44 picks up the image of the care-receiver's face.

Because the image pickup camera 44 is used as the anxiety detection sensor, the configuration of the anxiety measurement unit 50 of the first embodiment is changed to measure the degree of anxiety from the eyeball movement pattern. People have been reported (for example, see Japanese Patent Application Publication No. 2002-65609 (JP-A-2002-65609)) to demonstrate a specific eyeball movement reflecting the anxiety when they feel fear. Accordingly, the anxiety measurement unit 50 stores in advance an eyeball movement pattern specific to anxiety and the eyeball movement of the care-receiver that has been picked up by the camera 44 is compared with the pattern. The degree of anxiety is calculated correspondingly to a degree to which the eyeball movement of the care-receiver and the pattern match. Alternatively, the variation rate of the eyeball movement may be also calculated as the degree of anxiety. The threshold in the anxiety reduction control unit 100 is based on the eyeball movement.

In such a configuration, as the sense of anxiety in the care-receiver grows, the eyeballs of the care-receiver perform a specific movement. The eyeball movement is picked up by the pickup camera 44 and the speed is automatically restricted correspondingly to the sense of anxiety. As a result, the sense of anxiety in the care-receiver is reduced.

Figure 11:
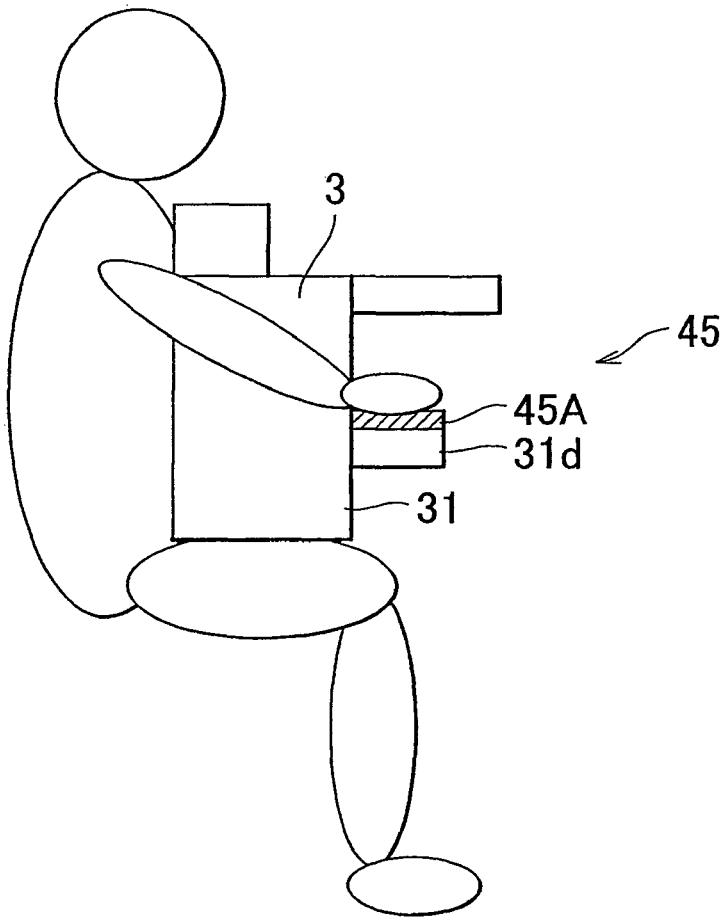
FIG. 11 shows a variation example 6.

(Variation Example 6) A variation example 6 will be explained below. A specific feature of the variation example 6 is in that a current sensor 45 that detects an electric resistance of the care-receiver's skin is used as an anxiety detection sensor that detects a degree of anxiety in the care-receiver. FIG. 11 is a side view illustrating a state in which the care-receiver is held in the holding device 3. A table section 31*d* protrudes at the rear surface side of the torso support section 31 of the holding device 3 (on the side of the torso support section 31 opposite from the care-receiver). An electrode 45A serving as the current sensor 45 is provided on the upper surface of the table section 31*d*. The care-receiver seating in the holding device 3 places a hand on the table section 31*d*. By passing a weak electric current to the care-receiver's hand via the electrode 45A, the current sensor 45 detects the variation in electric resistance of the care-receiver's skin.

Because the current sensor 45 is used as the anxiety detection sensor, the configuration of the anxiety measurement unit 50 of the first embodiment is changed to measure an electric resistance of skin from the sensor signal. The threshold in the anxiety reduction control unit 100 is based on the electric resistance of skin. An electric resistance of human skin is dependent on a level of strain (this is disclosed, for example, in http://www.ryohdohraku.com/index.htlm). In a strained state, when the sympathetic nerves are active, a current easily flows though the human body. In other words, the electric resistance decreases. Accordingly, when the speed limit is set in the speed limit setting unit 102, the speed limit is set correspondingly to the electric resistance of skin so that the upper limit speed of the motor decreases.

In such a configuration, as the sense of anxiety in the care-receiver grows, the electric resistance of skin decreases. This decrease in the electric resistance is detected by the current sensor 45 and the speed is automatically restricted correspondingly to the electric resistance of skin. As a result, the sense of anxiety in the care-receiver is reduced.

Figure 12:
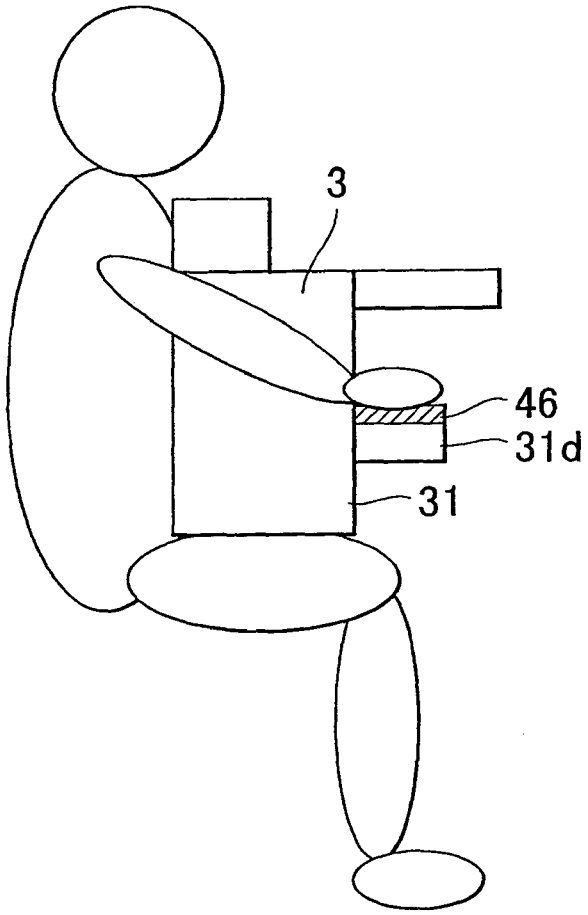
FIG. 12 shows a variation example 7.

(Variation Example 7) A variation example 7 will be explained below. A specific feature of the variation example 7 is in that a temperature sensor 46 that detects a skin temperature of the care-receiver is used as an anxiety detection sensor that detects a degree of anxiety in the care-receiver. FIG. 12 is a side view illustrating a state in which the care-receiver is held in the holding device 3. A table section 31*d* protrudes at the rear surface side of the torso support section 31 of the holding device 3 (on the side of the torso support section 31 opposite from the care-receiver). The temperature sensor 46 is provided on the upper surface of the table section 31*d*.

Figure 13:
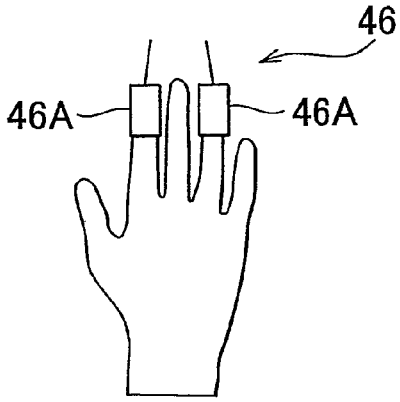
FIG. 13 shows an example in which an electrode is attached to a hand according to the variation example 7.
Figure 14:
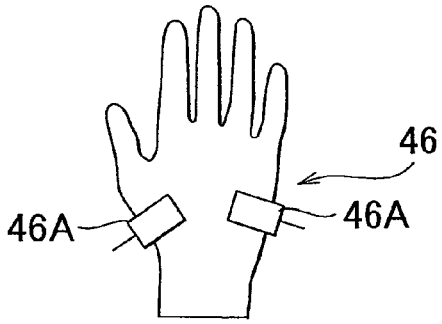
FIG. 14 shows another example in which an electrode is attached to a hand according to the variation example 7.
Figure 15:
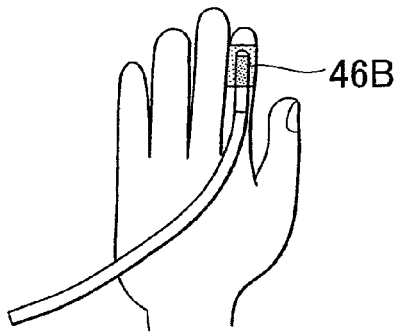
FIG. 15 shows an example in which a thermistor is attached to a hand according to the variation example 7.

An electrode 46A may be used as the temperature sensor 46. In this case, as shown in FIG. 13 or 14, the electrode 46A is brought into contact with the care-receiver's hand. A thermistor 46*b* may be also used as the temperature sensor 46. In this case, as shown in FIG. 15, a temperature detection spot of the thermistor 46B may be pasted on a finger.

Because the temperature sensor 46 is used as the anxiety detection sensor, the configuration of the anxiety measurement unit 50 of the first embodiment is changed to measure the skin temperature from the sensor signal. The threshold in the anxiety reduction control unit 100 is based on the skin temperature. The skin temperature of a human body depends on a level of strain, the skin temperature decreasing when a person is strained and increasing when the person is calm (relaxed). Accordingly, when the speed limit is set in the speed limit setting unit 102, the speed limit is set correspondingly to the decrease in skin temperature so that the upper limit speed of the motor decreases.

In such a configuration, as the sense of anxiety in the care-receiver grows, the skin temperature decreases. The decrease in skin temperature is detected by the temperature sensor 46 and the speed is automatically restricted correspondingly to the skin temperature. As a result, the sense of anxiety in the care-receiver is reduced.

Second Embodiment

Figure 16:
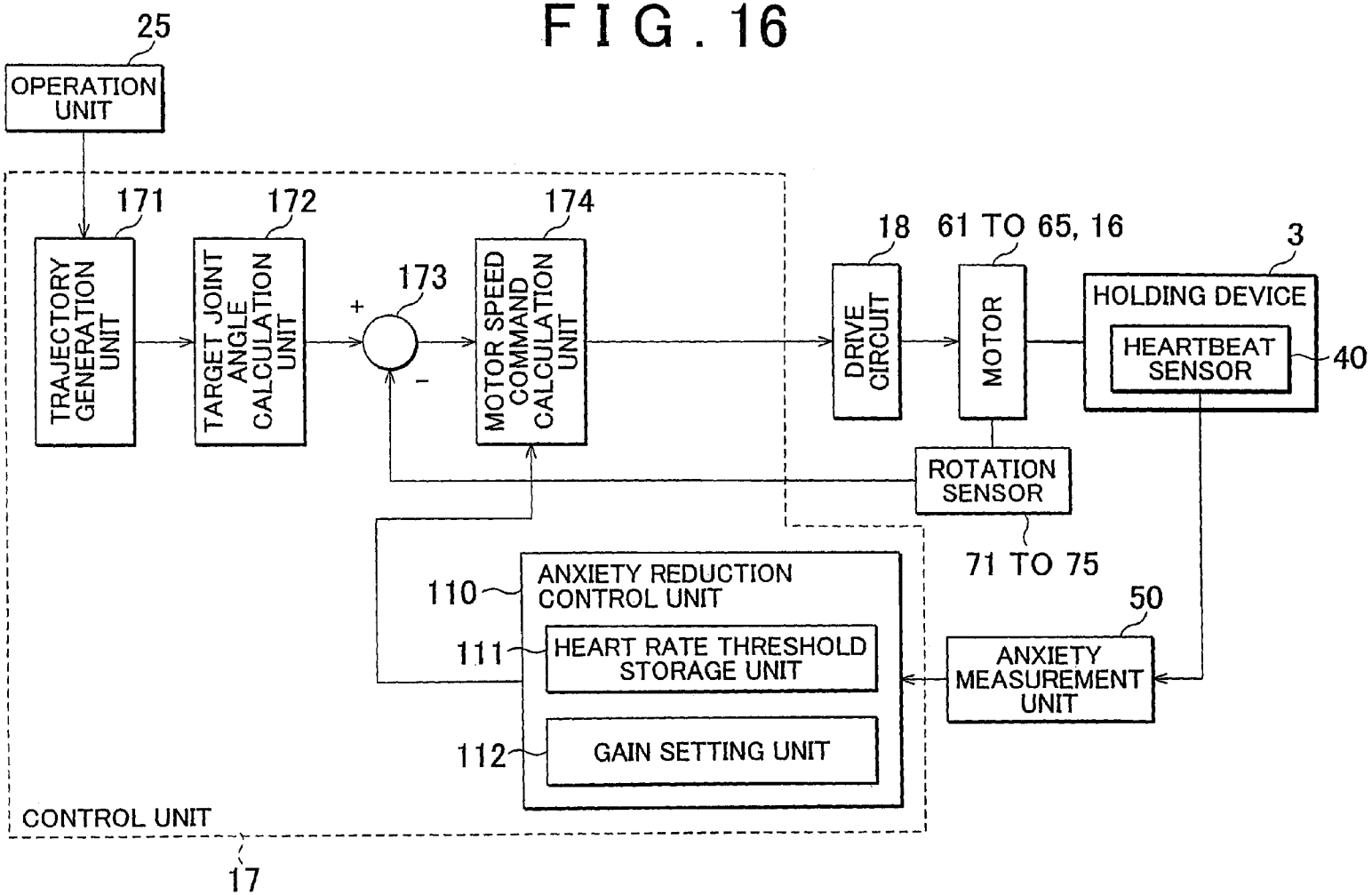
FIG. 16 is a functional block diagram of the control system according to a second embodiment.

The second embodiment of the invention will be described below. The basic configuration of the second embodiment is similar to that of the first embodiment, but a specific feature of the second embodiment is that the motor speed is adjusted by adjusting a gain with the anxiety reduction control unit 110. FIG. 16 is a functional block diagram of the second embodiment. In the second embodiment, the speed limit unit 175 is not provided. Instead, the anxiety reduction control unit 110 is provided with a heart rate threshold recording unit 111 and a gain setting unit 112.

Here, several stages are set for a heart rate threshold, and a gain that determines a response speed of the motor is set correspondingly to these thresholds at several stages. For example, the gain is set to decrease with the increase in a sense of anxiety (heart rate) correspondingly to the anxiety threshold (heart rate threshold).

The gain setting unit 112 compares the heart rate of the care-receiver that is provided from time to time from the anxiety degree measurement unit 50 with each threshold stored in the heart rate threshold recording unit 111 and determines an upper limit value of gain. The gain set in the gain setting unit 112 is provided to the motor speed command calculation unit 174. The motor speed command calculation unit 174 uses the gain that has been set and calculates a speed command that will be provided to the motors 61 to 65 and 16. The speed command that has thus been found is provided to each motor via the drive circuit 18, and the holding device 3 moves along the trajectory indicated by the operation unit 25.

Similarly to the first embodiment, in the second embodiment, the response of motors is delayed as the sense of anxiety in the care-receiver grows. Therefore, the movement speed of the holding device 3 is automatically delayed. As a result, even with a care-receiver who feels anxiety at a high movement speed, the movement speed is automatically reduced before the sense of anxiety becomes too strong, and the sense of anxiety is reduced.

The above-described variation examples 1 to 7 can be applied to the second embodiment.

Third Embodiment

Figure 17:
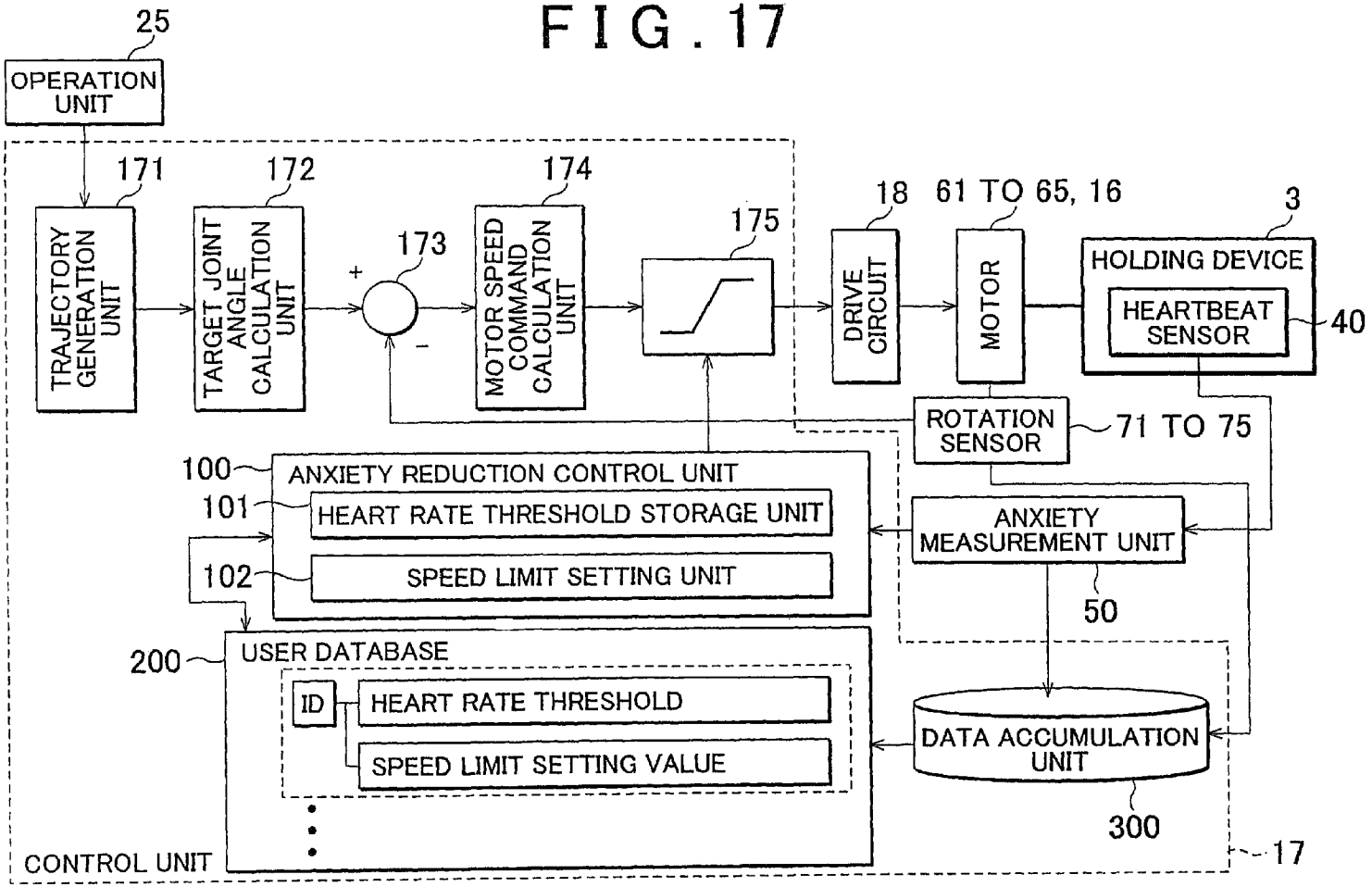
FIG. 17 is a functional block diagram of the control system according to a third embodiment.

The third embodiment of the invention will be described below. The basic configuration of the third embodiment is similar to that of the first embodiment, but a specific feature of the third embodiment is that optimum control is executed for each user. FIG. 17 is a functional block diagram of the third embodiment. In a case where one transfer assist apparatus 10 is shared by a plurality of care-receivers, reasons causing anxiety and degrees thereof differ among the care-receivers. In such a case, one control pattern should not be applied to all the care-receivers. Accordingly, in the third embodiment, the anxiety reduction control unit 100 is provided with a user database 200. Further, a data accumulation unit 300 is provided, and the sensor signals from the rotation sensors 71 to 75 and measurement values obtained with the anxiety measurement unit 50 are inputted in the data accumulation unit 300.

Anxiety thresholds (heart rate thresholds) and speed limit settings are recorded in association with a user ID in the user database 200. When the transfer assist apparatus 10 is used and the user ID of the care-receiver is inputted, the heart rate threshold and speed limit setting associated with the ID are read to the anxiety reduction control unit 100.

Figure 18:
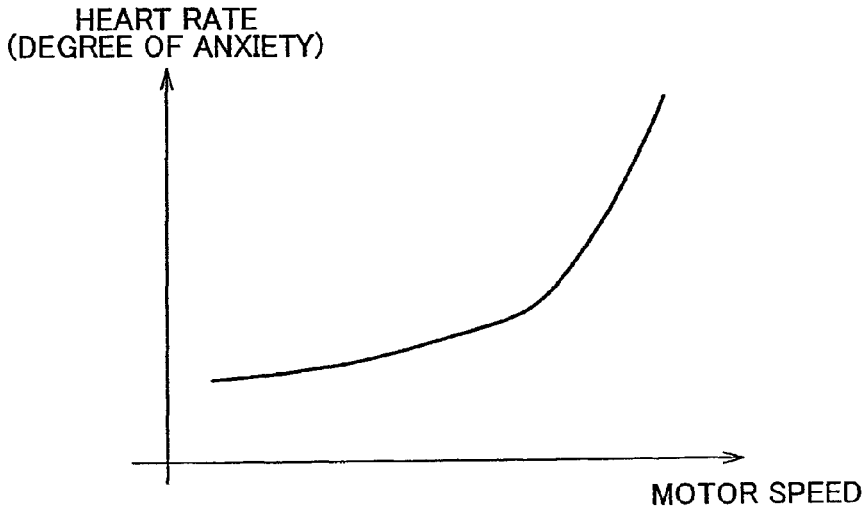
FIG. 18 shows an example of accumulated data according to the third embodiment.
Figure 19:
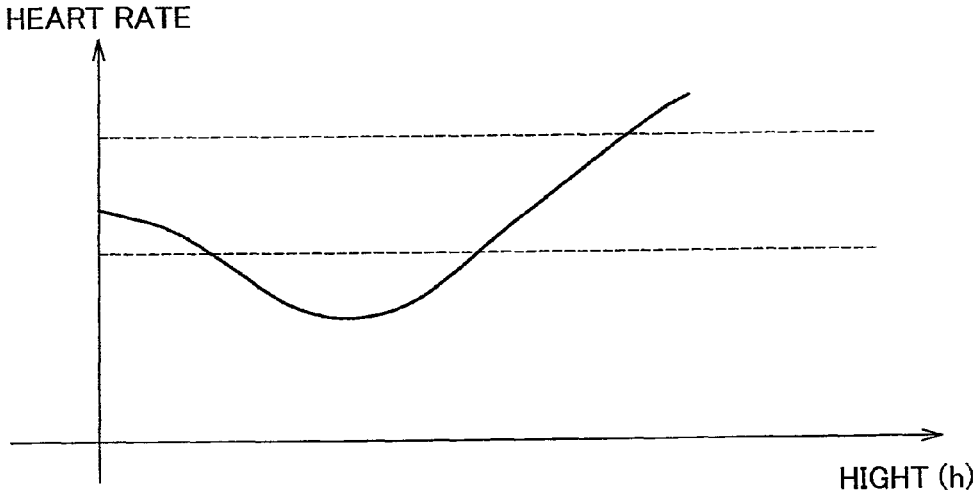
FIG. 19 shows another example of accumulated data according to the third embodiment.

The data accumulation unit 300 accumulates data obtained when the transfer assist apparatus is used for each user. Examples of the accumulated data include a relationship between a motor speed and a degree of anxiety, such as shown in FIG. 18, and a relationship between a height of the holding device 3 and a degree of anxiety, such as shown in FIG. 19.

With such a configuration, when the transfer assist apparatus 10 is used, first, the user ID of the care-receiver is inputted. As a result, the heart rate threshold and speed limit setting associated with the ID are read to the anxiety reduction control unit 100. The anxiety reduction control unit 100 executes the control of anxiety reduction on the basis of the heart rate threshold and speed limit setting that have been read out. At the same time, the data accumulation unit 300 collects and accumulates data relating to the sense of anxiety inherent to the care-receiver.

With such a configuration, optimum anxiety reduction control can be executed for each user. Furthermore, because data relating to anxiety are collected for each user, the movement transfer comfortable for each user can be indicated.

It goes without saying that the above-described variation examples 1 to 7 can be applied to the third embodiment.

Fourth Embodiment

Figure 20:
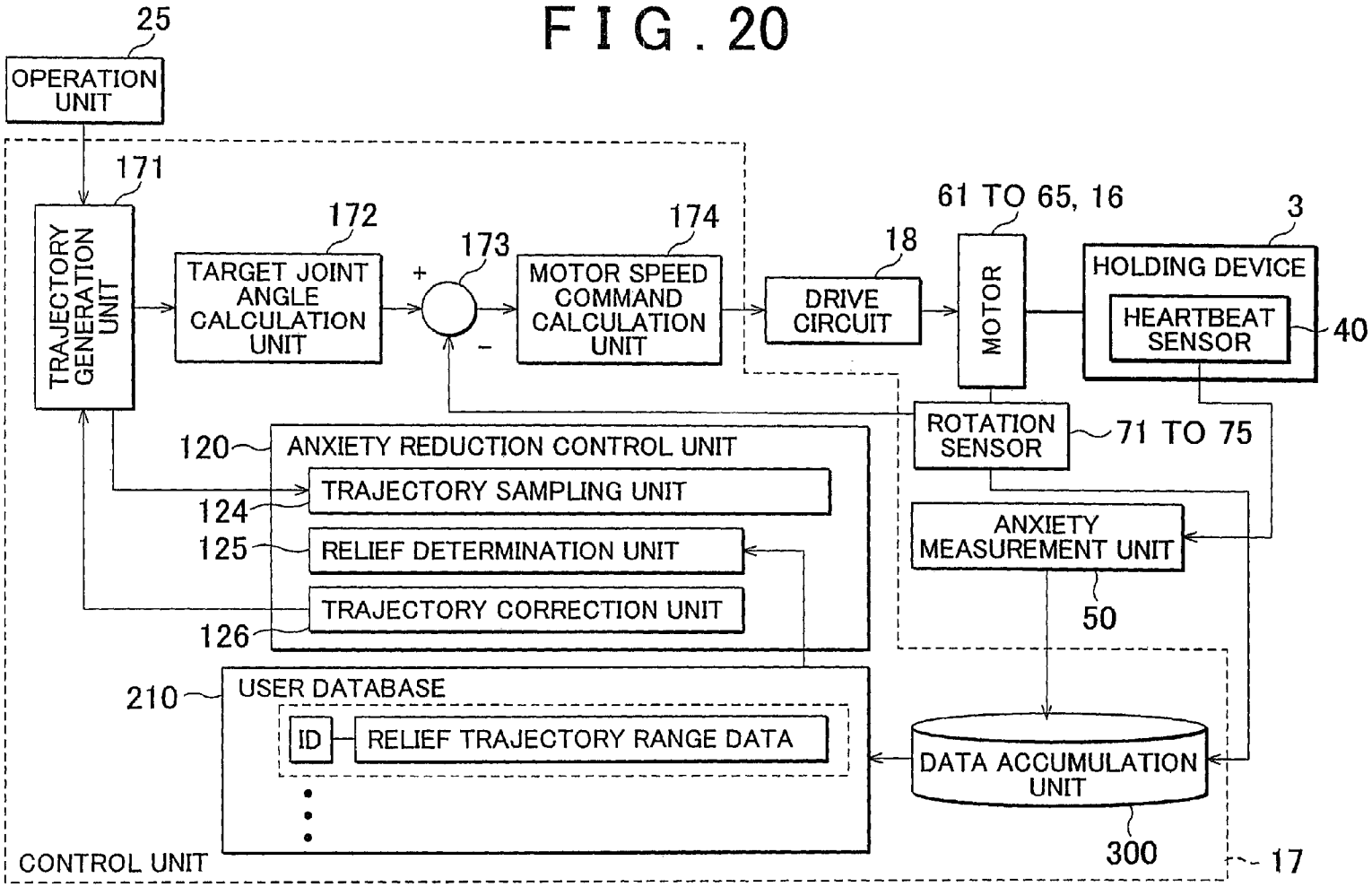
FIG. 20 is a functional block diagram of the control system according to a fourth embodiment.

The fourth embodiment of the invention will be described below. A specific feature of the fourth embodiment is in executing an automatic correction control producing a trajectory that creates a sense of relief in the care-receiver. FIG. 20 is a functional block diagram of the fourth embodiment. In the fourth embodiment, an anxiety reduction control unit 120 is provided with a trajectory sampling unit 124, a relief determination unit 125, and a trajectory correction unit 126.

Figure 21:
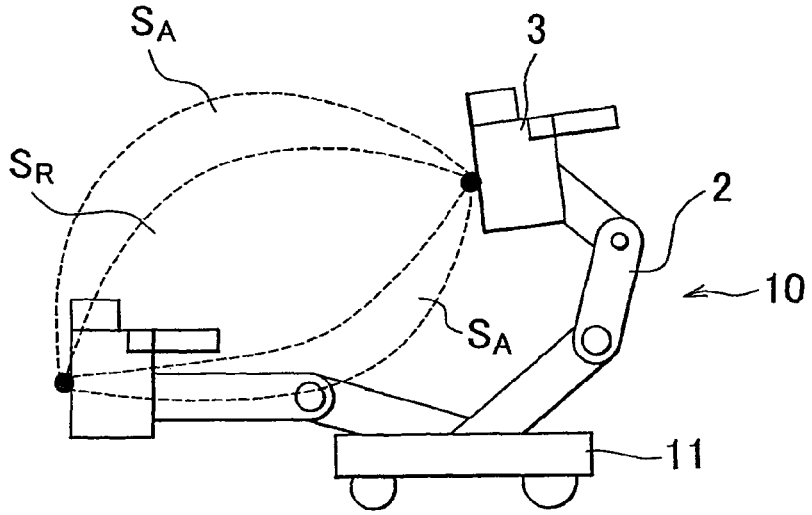
FIG. 21 shows an anxiety trajectory range and a relief trajectory range according to the fourth embodiment.

Further, data relating to a relief trajectory range are recorded in a user database 210 in association with the user ID. As shown in FIG. 19, a relationship between a height of the holding device 3 and a degree of anxiety is collected in the data accumulation unit 300. Therefore, as shown in FIG. 21, an anxiety trajectory range $S_A$ in which the care-receiver feels anxiety and a relief trajectory range $S_R$ in which the care-receiver feels relaxed can be separated and found by setting an appropriate threshold for a degree of anxiety. The relief trajectory range $S_R$ found in the above-described manner is recorded as the relief trajectory range in the user database.

The control operation performed by the anxiety reduction control unit 120 will be explained below together with the operation of the entire transfer assist apparatus 10. In transfer assisting the care-receiver, the nursing assistance conducts an operation of moving the holding device 3 by using the operation unit 25. An operation signal from the operation unit 25 is provided to the trajectory generation unit 171. Accordingly, the trajectory generation unit 171 generates a trajectory of the holding device 3 that corresponds to the operation signal. The drive control of the motors 61 to 65 and 16 is executed according to the generated trajectory.

The trajectory sampling unit 124 conducts sampling with a predetermined sampling pitch of the trajectory generated in the trajectory generation unit 171. The sampled coordinate data is provided to the relief determination unit 125. The relief determination unit 125 compares the sampled coordinate data with the relief trajectory range. In a case where the sampled coordinate data is within the relief trajectory range, the processing relating to the sampled coordinate data within the relief trajectory range is completed and a transition is made to the processing of the next sampled point.

Figure 22:
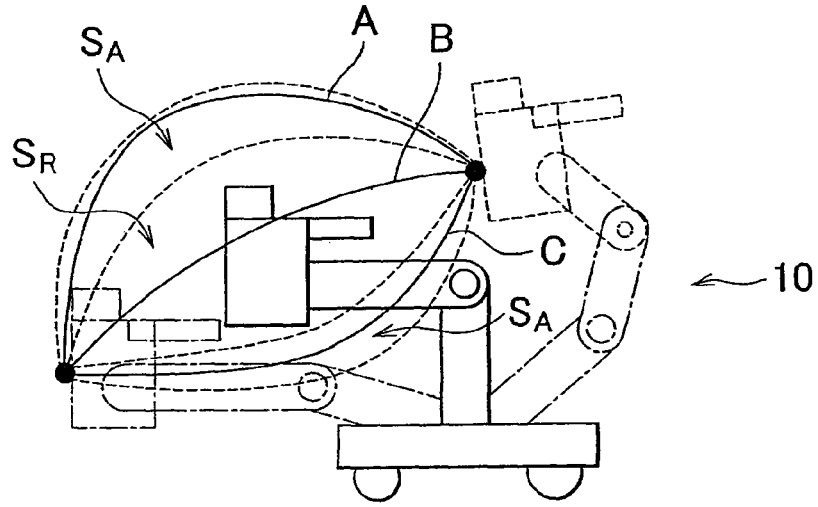
FIG. 22 shows a plurality of trajectories that connect a start point and a target point according to the fourth embodiment.

A plurality of routes connecting a start point and a target point can be considered as a trajectory indicated by the nursing assistant (operator). For example, a trajectory A, a trajectory B, and a trajectory C can be selected, as shown in FIG. 22. In this case, the trajectory B is within the relief trajectory range $S_R$, whereas the trajectory A and trajectory C are within the anxiety trajectory range $S_A$ and therefore undesirable. Accordingly, in a case where the inputted and instructed trajectory is within the anxiety trajectory range $S_A$, the trajectory correction unit 126 corrects the trajectory automatically so as to fit the trajectory into the relief trajectory range.

Figure 23:
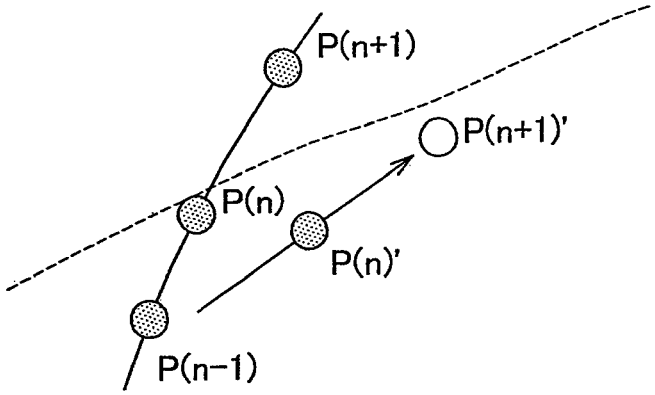
FIG. 23 shows an example of trajectory correction according to the fourth embodiment.

When the relief determination unit 125 determines that the coordinate data sampled in the trajectory sampling unit 124 is within the anxiety trajectory range $S_A$, the relief determination unit sends a trajectory correction instruction to the trajectory correction unit 126. Let us assume that the present location is P(n) shown in FIG. 23. Then, for example, where the sampling point P(n+1) enters the anxiety trajectory range $S_A$, as shown in FIG. 23, the trajectory has to be corrected. The trajectory correction unit 126 refers to the sampling point P(n) that immediately precedes the sampling point P(n+1) and is within the relief trajectory range $S_R$ and the next preceding sampling point P(n−1). When a point obtained by correcting the point P(n) is represented as a corrected point P(n)' and a predicted point that is predicted on an extending lime connecting the point P(n−1) and the corrected point P(n)' is represented as P(n+1)', the position of the corrected point P(n)' is established such that the predicted point P(n+1)' enters the relief trajectory range. The corrected point P(n)' thus found is provided to the trajectory generation unit 171. The trajectory generation unit 171 corrects the trajectory by replacing the position of the point P(n) with the corrected point P(n)' obtained by correction in the trajectory correction unit 126. As a result, the trajectory of the holding device 3 in the transfer assist operation is fit in the relief trajectory range $S_R$.

The motor drive control is continued based on the trajectory that has thus been corrected.

The trajectory of the holding device 3 in the transfer assist operation is determined by the operation command of the nursing assistant, but it does not mean that the nursing assistant knows fully and at all times the range in which the care-receiver feels anxiety. Furthermore, however attentive is the nursing assistance, operation errors are still possible. Accordingly, in the embodiment, a sense of anxiety in the care-receiver is reduced by automatically correcting the trajectory in a range in which the care-receiver can have a feeling of relief.

Figure 24:
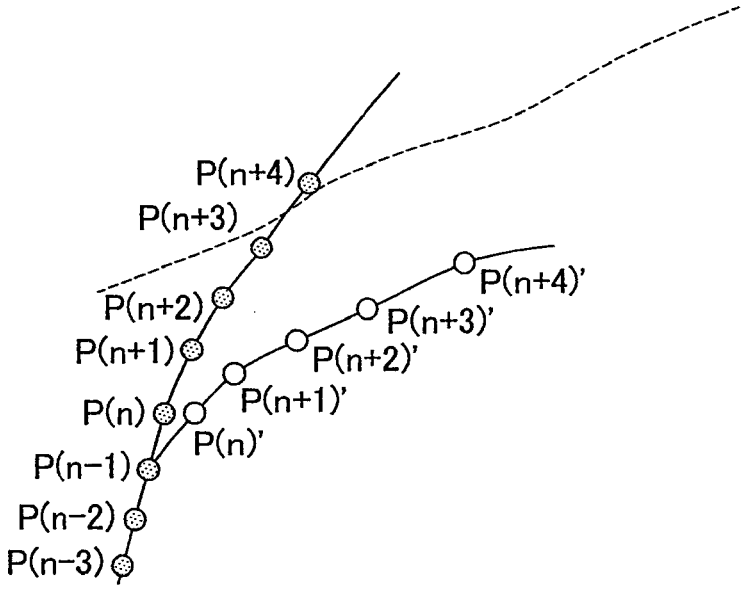
FIG. 24 shows an example of trajectory correction according to a variation example 8.

(Variation Example 8) In the fourth embodiment a case is explained by way of example in which the trajectory of one preceding point enters the anxiety trajectory range $S_A$, but because of the relationship between a sampling pitch of the CPU 17*a* and a motor speed, the correction of one sampling point can cause too abrupt changes. In such a case, the positions of a plurality of sampling points may be corrected as shown in FIG. 24. Thus, in FIG. 24, the positions of corrected points P(n)' to P(n+3)' are established such that the estimated point (for example, P(n+4)') that is several points in front of the point P(n) is within the relief trajectory range. The predicted point that takes into account a plurality of points in front may be calculated by linking vectors connected to an immediately preceding point and also, for example, by using an approximation curve such as a Bezier curve.

Fifth Embodiment

Figure 25:
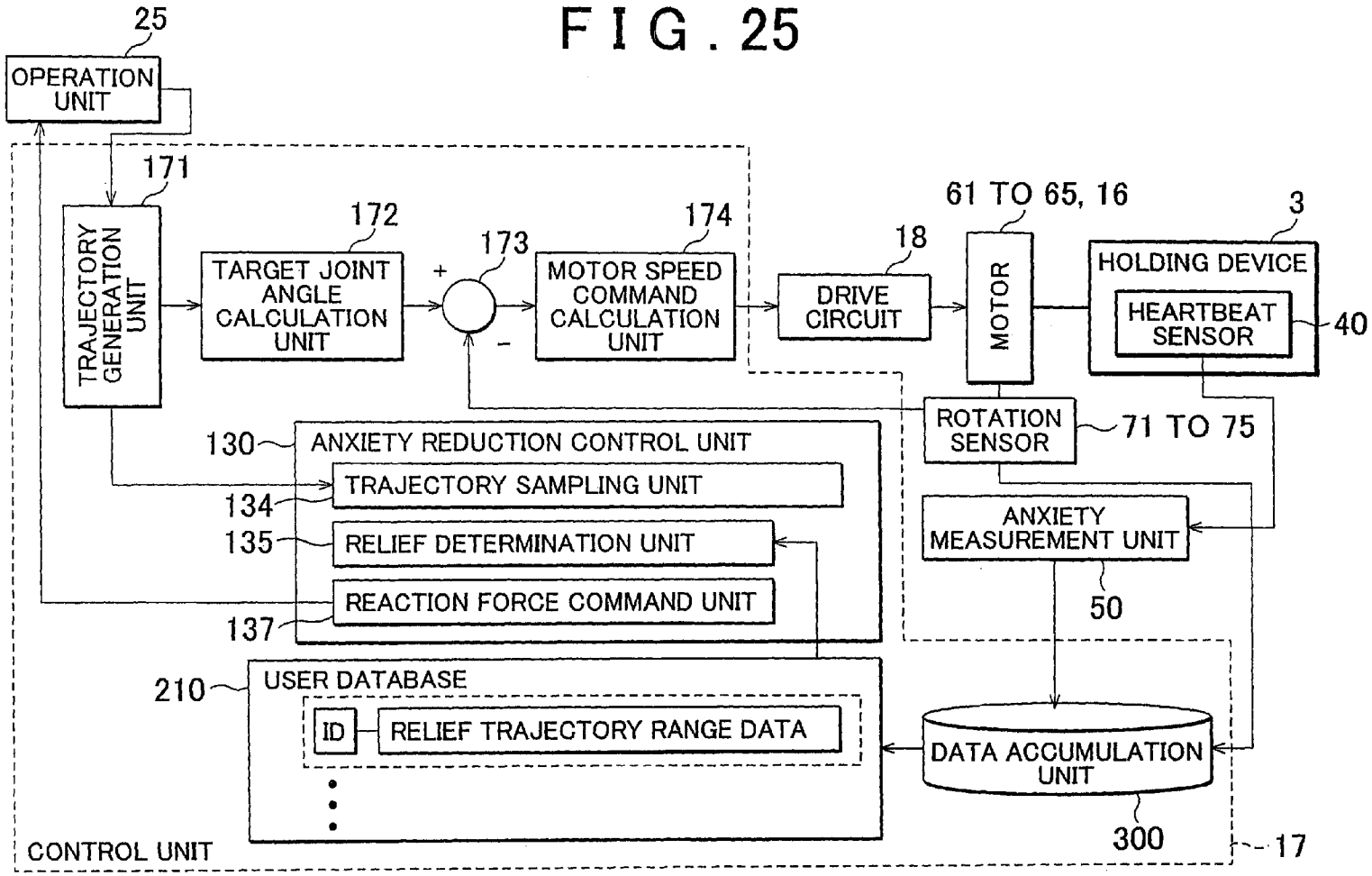
FIG. 25 is a functional block diagram of the control system according to a fifth embodiment.

The fifth embodiment of the invention will be described below. A specific feature of the fifth embodiment is in that a reaction force is applied to the lever 25A of the operation unit 25 when an inputted and instructed trajectory is within the anxiety trajectory range. FIG. 25 is a functional block diagram illustrating the fifth embodiment. In the fifth embodiment, the anxiety reduction control unit 130 is provided with a trajectory sampling unit 134, a relief determination unit 135, and a reaction force command unit 137.

The trajectory sampling unit 134 samples the trajectory generated in the trajectory generation unit 171. The relief determination unit 135 determines whether the sampling point is within the relief trajectory range $S_R$. When the relief determination unit 135 determines that the coordinate data sampled in the trajectory sampling unit 134 has entered the anxiety trajectory range $S_A$, the relief determination unit issues an instruction to generate a reaction force to the reaction force command unit 137.

Figure 26:
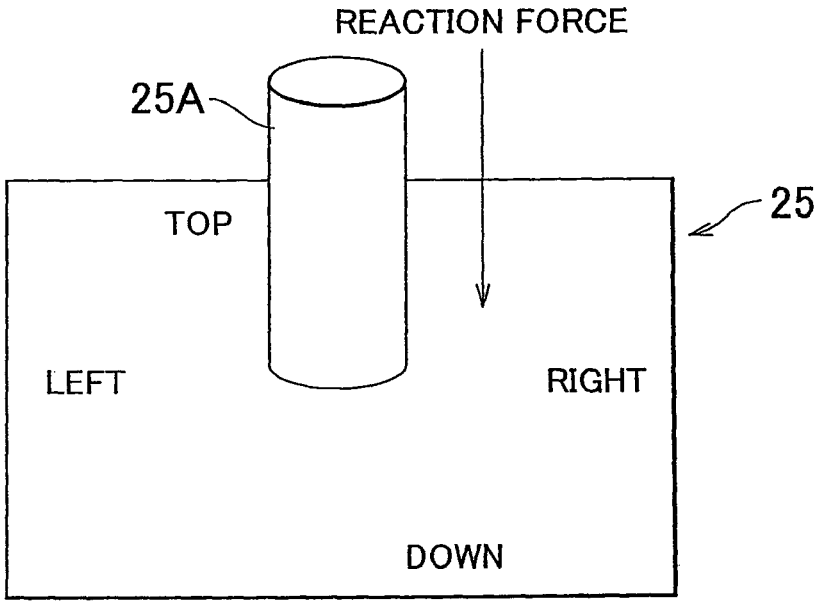
FIG. 26 shows a state in which a reaction force is applied to an operation lever according to the fifth embodiment.

The reaction force command unit 137 sends a command to generate a reaction force in a direction that causes a sensation of resistance to an input operation in which the trajectory is within the anxiety trajectory range $S_A$ and sends the command to the operation unit 25. For example, in a case where a transition to the anxiety trajectory range $S_A$ is made in the sampling point P(n+1), similarly to the fourth embodiment, the operator feels a resistance to the operation of shifting the operation lever 25A up. Thus, upon receiving the reaction force generation command from the reaction force command unit 137, the operation unit 25 produces a reaction force directed from the top down, as shown in FIG. 26.

With such a configuration, the nursing assistant (operator) feels a resistance when a trajectory is to be inputted that makes the care-receiver anxious. As a result, a feedback designed to return the trajectory into the relief trajectory range $S_R$ is provided to the nursing assistance (operator). Therefore a sense of anxiety in the care-receiver is reduced.

Figure 27:
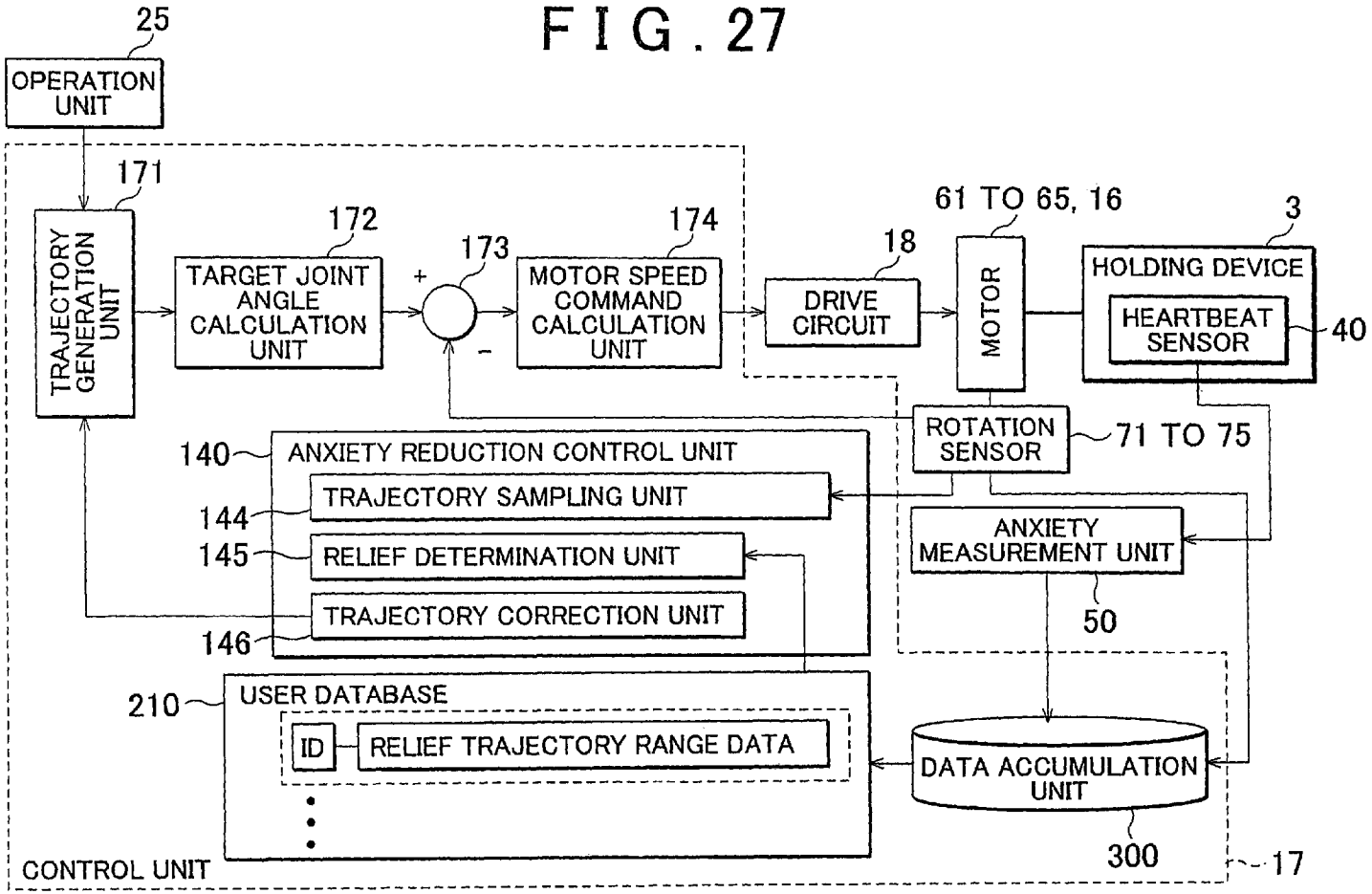
FIG. 27 is a functional block diagram of the control system according to a variation example 9.

(Variation Example 9) In the above-described fourth embodiment, the variation example 8, and the fifth embodiment, a case is explained by way of example in which the trajectory sampling units 124 and 134 sample the trajectories generated in the trajectory generation unit 171. By contrast, in variation example 9, as shown in FIG. 27, the output of rotation sensors 71 to 75 may be inputted to a trajectory sampling unit 144. The trajectory sampling unit 144 calculates from time to time the present position of the holding device 3 on the basis of the output of rotation sensors 71 to 75. Further, the next point is predicted based on the several past points. For example, the next point P(n+1) may be predicted by extending a vector connecting the point P(n−1) and the point P(n), or a point in front may be predicted by applying a curve approximation such as a Bezier curve to a plurality of past points. The predicted points that have thus been found are provided to the relief determination unit 145. Such a configuration also makes it possible to correct the trajectory automatically to a range in which the care-receiver can have a sense of relief. Therefore, the sense of anxiety in the care-receiver is reduced.

Sixth Embodiment

Figure 28:
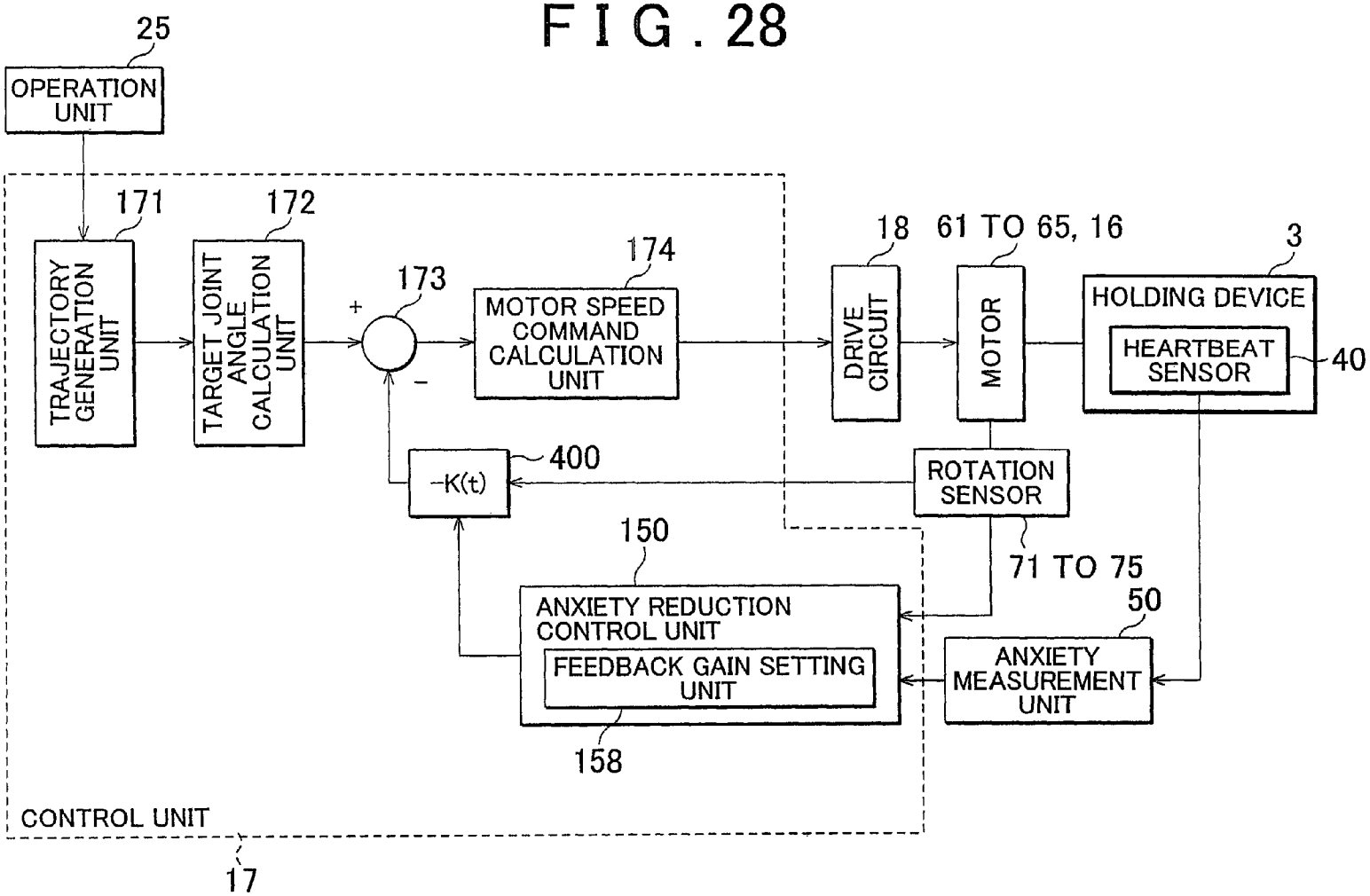
FIG. 28 is a functional block diagram of the control system according to a sixth embodiment.

The sixth embodiment of the invention will be described below. A specific feature of the sixth embodiment is that a feedback gain is adjusted so as to minimize an evaluation function based on a sense of anxiety. FIG. 28 is a functional block diagram of the sixth embodiment. In the sixth embodiment an anxiety reduction control unit 150 has a feedback gain setting unit 158. A gain multiplication unit 400 is provided in a loop from the rotation sensors 71 to 75 to a synthesis means 173.

Sensor values for the rotation sensors 71 to 75 and measured values of a degree of anxiety that have been measured in the anxiety measurement unit 50 are inputted to the anxiety reduction control unit 150. The feedback gain setting unit 158 of the anxiety reduction control unit 150 sets the gain of the gain multiplication unit 400. For example, an optimum regulator can be used as a means for adjusting the gain. A model for setting a feedback gain as an optimum regulator will be explained below.

The degree of anxiety in the care-receiver is modeled by the following Equation (1).

$$\dot{a}=r\cdot v+q\cdot h+0\cdot a \tag{1}$$

Here, a stands for a degree of anxiety, a dot above a means a first-order derivative of the degree of anxiety. v stands for a speed of the holding device 3, h stands for a height of the holding device 3, r and q stand for weight coefficients. Where the speed v and height h are vectors, a positive-definite matrix is obtained.

[v, h, a] is a state variation and a state equation of the transfer assist apparatus 10 can be represented as follows.

$$\frac{d}{dx}\begin{bmatrix} v \\ h \\ a \end{bmatrix} = \begin{bmatrix} a_1 & a_2 & 0 \\ a_3 & a_4 & 0 \\ r & q & 0 \end{bmatrix}\begin{bmatrix} v \\ h \\ a \end{bmatrix} + \begin{bmatrix} b_1 \\ b_2 \\ b_3 \end{bmatrix} u \tag{2}$$

Here, $a_1$ to $a_4$ and $b_1$ to $b_3$ represent a coefficient matrix that includes a feedback control system and a plant model that are inherent to the transfer assist apparatus 10.

A feedback gain as an optimum regulator is found by solving the Riccati equation with respect to Equation (2) above. Equation (2) is represented as follows.

$$\dot{x}=Ax+Bu \tag{3}$$

In this case, the following equation is solved.

$$PA+A^TP-PBR^{-1}B^TP+Q=0 \tag{4}$$

Where P is taken as a positive constant, the feedback can be represented as follows.

$$K(t)=R^{-1}B^TP(t) \tag{5}$$

In a case where the control system of the transfer assist apparatus is a nonlinear feedback system in which a coefficient varies with time, the optimum feedback gain has to be sequentially computed.

The gain K that has thus been calculated is set as a gain of the gain multiplication unit 400. As a result, the feedback is automatically applied so as to reduce the sense of anxiety in the care-receiver that is associated with the height h and speed v of the holding device 3, and the sense of anxiety in the care-receiver is reduced.

Seventh Embodiment

Figure 29:
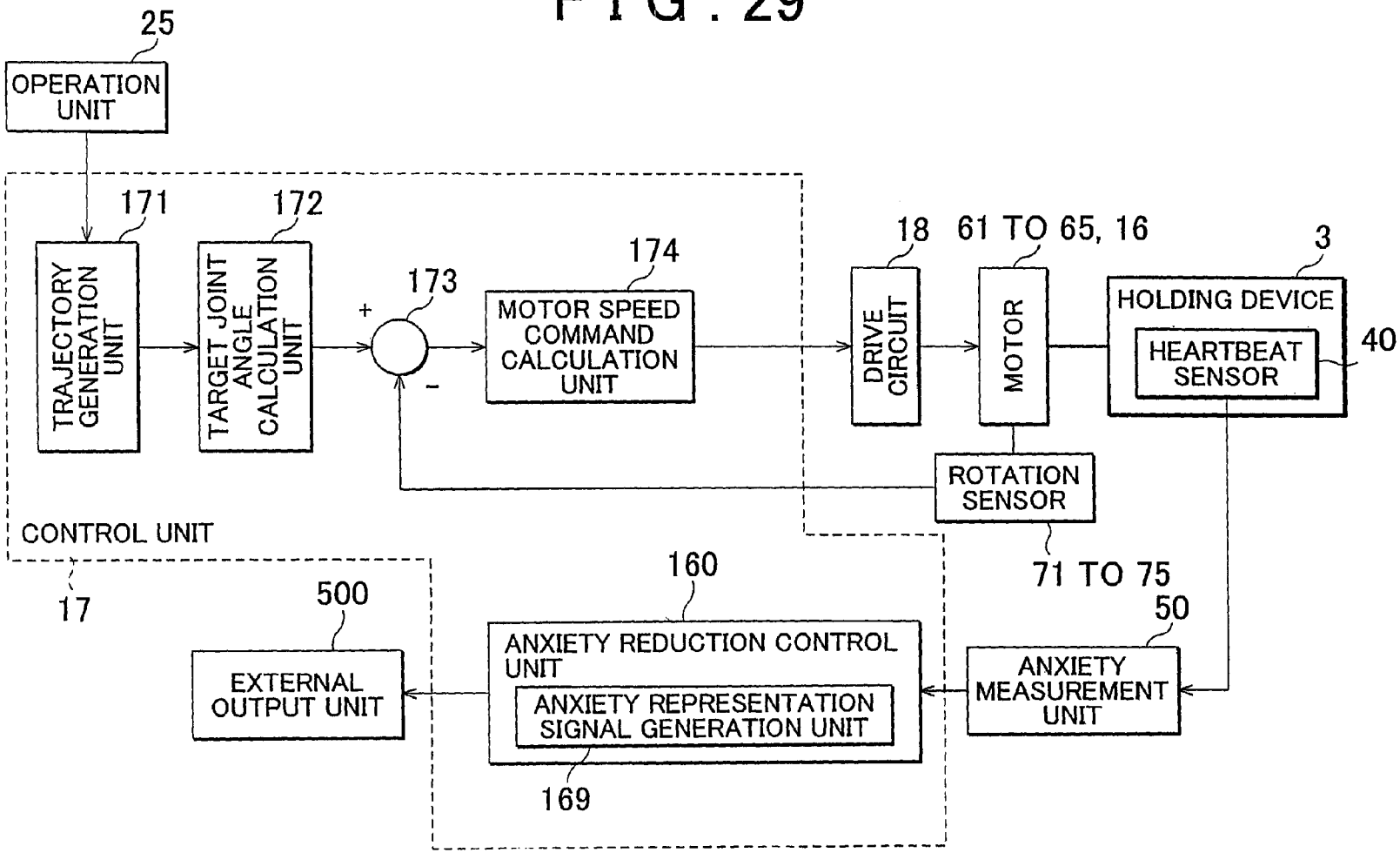
FIG. 29 is a functional block diagram of the control system according to a seventh embodiment.

The seventh embodiment of the invention will be explained below. A specific feature of the seventh embodiment is that the operator (nursing assistant) is notified to the effect that the care-receiver has a sense of anxiety. FIG. 29 is a functional block diagram of the seventh embodiment. In the seventh embodiment, an anxiety reduction control unit 160 is provided with an anxiety representation signal generation unit 169. Further, an anxiety representation signal generated in the anxiety representation signal generation unit 169 is outputted in the form of a sound or vibrations from an external output unit 500.

Figure 30:
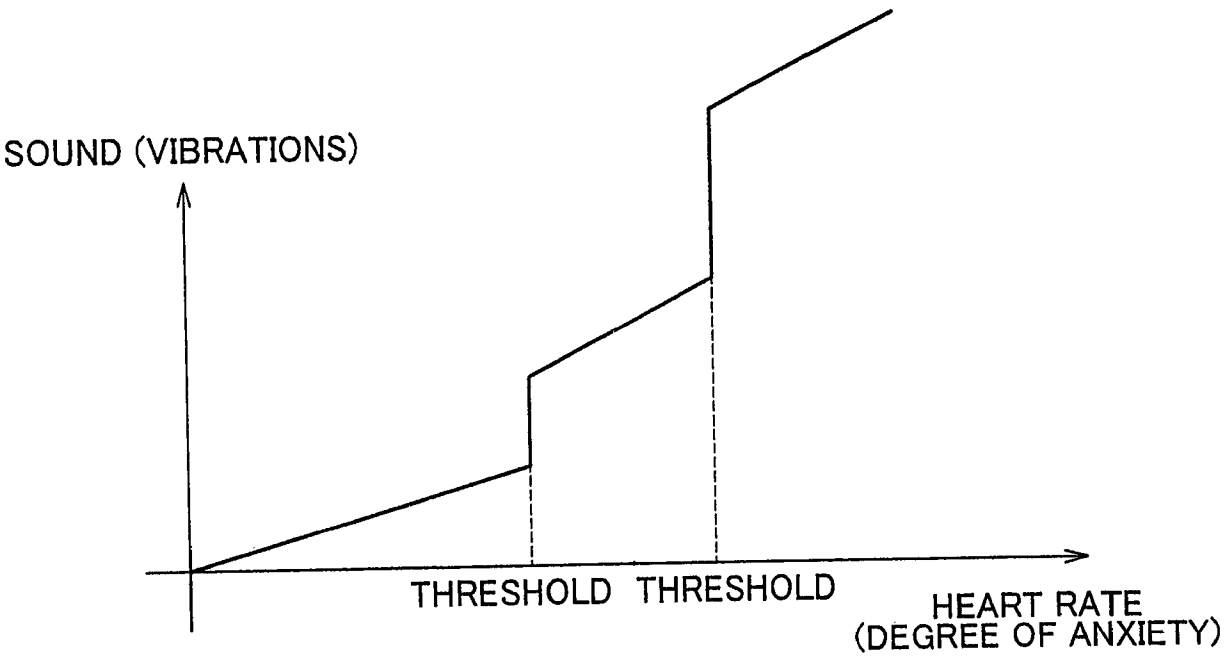
FIG. 30 shows the relationship between a heart rate (degree of anxiety) of the care-receiver and an anxiety representation signal according to the seventh embodiment.

The anxiety representation signal generation unit 169 generates an anxiety representation signal correspondingly to the degree of anxiety in the care-receiver. FIG. 30 shows a relationship between a heart rate (degree of anxiety) of the care-receiver and an anxiety representation signal. The anxiety representation signal is set to increase together with the sense of anxiety felt by the care-receiver. Further, a predetermined threshold is set for the heart rate (degree of anxiety), and the anxiety representation signal is set to increase rapidly when the heart rate (degree of anxiety) exceeds the threshold.

A speaker or a vibrator can be used as the external output unit 500. It is preferred that the anxiety representation signal that is linked to the sense of anxiety in the care-receiver be not transmitted to the care-receiver himself. Otherwise, the sense of anxiety in the care-receiver can be augmented. For example, a small speaker may be provided at the distal end of the operation lever 25A so that the anxiety representation signal may be heard only by the operator (nursing assistant). Alternatively, a vibrator may be incorporated in the operation lever 25A and vibrations may be transmitted to the hand of the operator (nursing assistant).

In such a configuration, the operator is notified about the sense of anxiety felt by the care-receiver. In a case where the anxiety representation signal gradually increases and then rapidly increases, measures can be taken to alleviate the sense of anxiety in the care-receiver. For example, the care-receiver can be spoken to, the movement can be slowed down, and the trajectory can be changed so as to avoid excess increase in height. As a result, the sense of anxiety in the care-receiver can be reduced.

It goes without saying that the above-described variation examples 1 to 7 can be similarly applied to the seventh embodiment.

The invention is not limited to above-described embodiments and can be variously changed without departing from the scope of the invention. For example, in the embodiments a case is explained in which a threshold is set for a degree of anxiety and the speed limit or gain is decreased in a stepwise manner. However, it goes without saying that the upper limit of the speed limit or gain may be changed continuously in response to the degree of anxiety. The system configuration of the above-described embodiments involves only the position feedback, but a speed or acceleration feedback may be also used.

What is claimed is:

1. A transfer assist apparatus that assists a care-receiver transfer, comprising:

a movable carriage unit;

an arm unit that includes a base end attached to the carriage unit and that rotates in a horizontal plane and tilted;

a body holding device that is attached to the arm unit;

a drive unit that drives the carriage unit and the arm unit;

an operation unit into which a trajectory of the body holding device is inputted by a manual operation; and an anxiety measurement unit that detects a physical change in the body of the care-receiver, the physical change being indicative of the care-receiver's degree of anxiety; and a control unit that controls the drive unit according to the trajectory inputted by the operation unit and performs feedback control so as to reduce the care-receiver's state of anxiety, wherein the anxiety measurement unit determines an increase in anxiety when at least one of the following physical changes in the body of the care-receiver occurs: an increase in heart rate, an increase in an amount of perspiration, an increase in a breathing rate, a change in an eyeball movement pattern, a decrease in an electric resistance of the skin of a care-receiver, and a decrease in skin temperature, and wherein the movement speed of the holding device is restricted correspondingly to the degree of anxiety in the care-receiver that is measured by the anxiety measurement unit.

2. The transfer assist apparatus according to claim 1, wherein the control unit sets a speed limit that is an upper limit of a drive speed of the drive unit according to the degree of anxiety in the care-receiver, and restricts the drive speed of the drive unit not to exceed the speed limit.

3. The transfer assist apparatus according to claim 1, wherein the control unit sets a gain that determines a response speed of the drive unit according to the degree of anxiety in the care-receiver, and sends a drive command to the drive unit by using the gain that is set.

4. The transfer assist apparatus according to claim 3, wherein the control unit sets the gain to decrease as the degree of anxiety in the care-receiver increases.

5. The transfer assist apparatus according to claim 1, wherein the control unit includes a user database that stores, for each user, the degree of anxiety and a setting value to reduce the degree of anxiety.

6. The transfer assist apparatus according to claim 5, wherein the setting value includes a speed limit that is an upper limit of a drive speed of the driver unit and is set according to the degree of anxiety.

7. The transfer assist apparatus according to claim 1, wherein the control unit includes a data accumulation unit that accumulates, for each user, data when the transfer assist apparatus is used.

8. The transfer assist apparatus according to claim 7, wherein the accumulated data include, for each user, a relationship between the degree of anxiety and the drive speed of the driver unit and a relationship between the degree of anxiety and a position of the body holding device.

9. The transfer assist apparatus according to claim 1, wherein the control unit sets a feedback gain that minimizes an evaluation function that is based on a degree of anxiety in the care-receiver and a position and speed of the body holding device, and uses the set feedback gain in a position, speed, or acceleration feedback loop.

10. The transfer assist apparatus according to claim 1, further comprising an external output unit that outputs an anxiety representation signal that increases as the degree of anxiety in the care-receiver increases, wherein the control unit generates the anxiety representation signal and outputs the signal to the external output unit to represent the degree of anxiety to an operator.

11. The transfer assist apparatus according to claim 10, wherein the external output unit includes a speaker or a vibrator attached to the operation unit and transmits the anxiety representation signal to an operator by sound or vibrations.

12. A transfer assist apparatus that assists a care-receiver transfer, comprising:

a movable carriage unit;

an arm unit that is attached to the carriage unit and that rotates in a horizontal plane and tilted;

a body holding device that is attached to the arm unit;

a drive unit that drives the carriage unit and the arm unit;

an operation unit into which a trajectory of the body holding device is inputted by a manual operation; and a control unit that controls the drive unit according to the trajectory inputted by the operation unit, and performs a feedback control to reduce the care-receiver's degree of anxiety by storing in advance a relief trajectory range, which is a trajectory range of the body holding device in which the care-receiver has a feeling of relief from anxiety, sampling with a predetermined sampling pitch a trajectory of the body holding device that is inputted by an operator via the operation unit, comparing sampled coordinate data on the trajectory with the relief trajectory range, and when the sampled coordinate data is outside the relief trajectory range or when a point predicted based on sampled coordinate data within the relief trajectory range is predicted to be outside the relief trajectory range, correcting the trajectory of the body holding device to enter the relief trajectory range.

13. The transfer assist apparatus according to claim 12, wherein the control unit corrects, when the sampled coordinate data is outside the relief trajectory range or when the predicted point is predicted to be outside the relief trajectory range, a position of a point sampled immediately before the sampled coordinate data is sampled or the predicted point is predicted, or at least one point sampled before the sampled coordinate data is sampled or the predicted point is predicted, and generates a trajectory that is corrected such that a point predicted based on the corrected sampled position is within the relief trajectory range.

14. The transfer assist apparatus according to claim 12, wherein:

the control unit samples a trajectory of the body holding device by calculating from time to time a position of the body holding device on the basis of a drive amount of the drive unit.

15. The transfer assist apparatus according to claim 12, wherein:

the control unit includes a user database that stores, for each user, the relief trajectory range.

16. A transfer assist apparatus that assists a care-receiver transfer, comprising:

a movable carriage unit;

an arm unit that includes a base end attached to the carriage unit and that rotates in a horizontal plane and tilted;

a body holding device that is attached to the arm unit;

a drive unit that drives the carriage unit and the arm unit;

an operation unit into which a trajectory of the body holding device is inputted by a manual operation; and a control unit that controls the drive unit according to the trajectory inputted by the operation unit, and performs a feedback control to reduce the care-receiver's degree of anxiety by storing in advance a relief trajectory range, which is a trajectory range of the body holding device in which the care-receiver has a feeling of relief from anxiety, sampling with a predetermined sampling pitch a trajectory of the body holding device that an operator inputs by the operation unit, comparing sampled coordinate data on the trajectory with the relief trajectory range, and when the sampled coordinate data is outside the relief trajectory range or when a point predicted based on sampled coordinate data within the relief trajectory range is predicted to be outside the relief trajectory range, instructing the operation unit to generate a reaction force in a direction that causes resistance to an input operation that inputs the trajectory that deviates from the relief trajectory range.

17. The transfer assist apparatus according to claim 16, wherein:

the control unit samples a trajectory of the body holding device by calculating from time to time a position of the body holding device on the basis of a drive amount of the dive unit.

18. The transfer assist apparatus according to claim 17, wherein:

the control unit includes a user database that stores, for each user, the relief trajectory range.

* * * * *

UNITED STATES PATENT AND TRADEMARK OFFICE

CERTIFICATE OF CORRECTION

PATENT NO. : 8,621,684 B2
APPLICATION NO. : 13/145692
DATED : January 7, 2014
INVENTOR(S) : Y. Okumatsu It is certified that error appears in the above-identified patent and that said Letters Patent is hereby corrected as shown below:

In the Specification

At column 1, line 4, after the title, add the following paragraph:

-- This is a 371 national phase application of PCT/IB2010/000167 filed 21 January 2010, claiming priority to Japanese Patent Application No. 2009-011997 filed 22 January 2009, the contents of which are incorporated herein by reference. --.

At column 15, line 29, change " $\dot{a} = r \cdot v + q \cdot h + 0 \cdot a$ " to -- $\dot{a} = r \cdot v + q \cdot h + 0 \cdot a$ | --.

Signed and Sealed this
Twenty-fourth Day of June, 2014

Michelle K. Lee

Michelle K. Lee
*Deputy Director of the United States Patent and Trademark Office*